US012722828B2

(12) United States Patent
Tondera et al.

(10) Patent No.: US 12,722,828 B2
(45) Date of Patent: Sep. 1, 2026

(54) ARRANGEMENT AND METHOD FOR TRANSFERRING A CONTAINER PROVIDED WITH A CONTAINER OPENING

(71) Applicant: TT Innovation AG, Zug (CH)

(72) Inventors: Marc Tondera, Riehen (CH); Mathieu Müller, Sierentz (FR); Julia Annette Carli, Basel (CH); Philipp Leuenberger, Basel (CH); Mike Zeller, Wahlen (CH)

(73) Assignee: TT Innovation AG, Zug (CH)

( * ) Notice: Subject to any disclaimer, the term of this patent is extended or adjusted under 35 U.S.C. 154(b) by 0 days.

(21) Appl. No.: 18/866,706

(22) PCT Filed: May 17, 2023

(86) PCT No.: PCT/EP2023/063382
§ 371 (c)(1),
(2) Date: Nov. 18, 2024

(87) PCT Pub. No.: WO2023/222828
PCT Pub. Date: Nov. 23, 2023

(65) Prior Publication Data

US 2025/0353631 A1 Nov. 20, 2025

(30) Foreign Application Priority Data

May 18, 2022 (EP) ..... 22174046
Jul. 22, 2022 (DE) ..... 102022118418.8

(51) Int. Cl.
*B65B 5/04* (2006.01)
*B65B 43/46* (2006.01)

(52) U.S. Cl.
CPC ..... *B65B 43/46* (2013.01); *B65B 5/04* (2013.01)

(58) Field of Classification Search
USPC ..... 53/473
See application file for complete search history.

(56) References Cited

U.S. PATENT DOCUMENTS

2017/0225814 A1* 8/2017 Eberhardt ..... B65B 7/2821
2019/0315004 A1* 10/2019 Bechini ..... B25J 21/005
2022/0194646 A1* 6/2022 Procyshyn ..... B65B 69/00

FOREIGN PATENT DOCUMENTS

DE 102020102768 A1 8/2021
EP 3945046 A1 2/2022

* cited by examiner

*Primary Examiner* — Chinyere J Rushing-Tucker
(74) *Attorney, Agent, or Firm* — Volpe Koenig

(57) ABSTRACT

An arrangement (1), a filling device (18) and a method for transferring a container (6) provided with a preferably closable or closed container opening (9) from an input region (2) into an output region (3) are provided, wherein the container (6) is held in the input region (2) by a first transport device (7), and the container (6) is transferred to a second transport device (8), which is disposed in the output region (3), through an opening (5) in a bulkhead (4). The input region (2) and the output region (3) are separated by the bulkhead (4), and the container (6), for transferring, is gripped by the first transport device (7) at a different distance from the container opening (9) than by the second transport device (8).

25 Claims, 13 Drawing Sheets

ARRANGEMENT AND METHOD FOR TRANSFERRING A CONTAINER PROVIDED WITH A CONTAINER OPENING

CROSS-REFERENCE TO RELATED APPLICATIONS

This application is a 371 National Phase of International Application No. PCT/EP2023/063382, filed May 17, 2023, which claims priority from European Patent Application No. 22174046.7, filed May 18, 2022, and German Patent Application No. 10 2022 118 418.8, filed Jul. 22, 2022, all of which are incorporated herein by reference as if fully set forth.

TECHNICAL FIELD

The invention relates to an arrangement having at least one input region and one output region which are mutually separated by a bulkhead, wherein the bulkhead has at least one opening through which at least one container having a preferably closable or closed container opening is able to be transferred, wherein the input region has a first transport device, and the output region has a second transport device, for transfer.

The invention furthermore relates to a filling device which has at least one filling station and which is disposed in an output region, preferably in an arrangement as described hereunder.

The invention furthermore relates to a method for transferring a container provided with a container opening from an input region to an output region, wherein the container in the input region is held by a first transport device, and the container is transferred to a second transport device, which is disposed in the output region, through an opening in a bulkhead, wherein the input region and the output region are separated by the bulkhead.

BACKGROUND

In the production of pharmaceutical products, or in the production of foodstuffs, containers are in most instances transported within and between protected regions, preferably as part of an isolator or of a RABS (restricted access barrier system). In the process, the transfer of containers (with a container opening) from one protected region, for example an input region, to another protected region, for example an output region, is particularly critical. While transferring, a transport device often reaches through the opening into a protected region, and/or the transport device comes so close to the opening that a protected region may be contaminated. Contaminations are to be avoided in particular in the production of the above-described products, so that the arrangements known in the prior art, as mentioned at the outset, are associated with many disadvantages in terms of the production process. Furthermore, contaminations are to be prevented for the protection of the environment or of the workforce (in the case of toxic/high-potent products).

SUMMARY

It is therefore an object of the invention to improve transfers of containers, preferably in protected regions. Furthermore, filling containers in protected regions is to be improved.

According to the invention, one or more of the features disclosed herein are provided for achieving the object mentioned. According to the invention, it is thus in particular proposed for achieving the object mentioned in an arrangement of the type described at the outset that the first transport device and the second transport device are designed in such a way that the at least one container is able to be gripped by the first transport device at a different distance from the container opening than by the second transport device. It is advantageously achieved as a result that the at least one container is gripped by the first and the second transport device at different positions. As a result, a sufficient spacing between the first and the second transport device can be implemented during transfer, whereby any contamination of a transport device by the other transport device and/or any contamination of the at least one container can be reduced or even avoided. In particular, it can be achieved in this way that only the respective container makes its way from the input region into the output region, while the transport devices can remain on the respective side of the opening.

Furthermore, an arrangement according to the invention can enable flexible design embodiments and uses of transport devices as well as of protected regions, such as the at least one input region and the at least one output region. The input region and/or the output region can in each case be designed as a closed chamber, in particular as a protected region.

The first transport device can be of the same type of construction as the second transport device. It can also be provided that the first and the second transport device are of different designs. In general, at least any transport device known to the person skilled in the art can be part of an arrangement according to the invention.

The bulkhead can be designed as part of the input region and/or of the output region, as a separate construction element, or as an element of a further component. The bulkhead has at least one opening which can be adapted to a circumference of the at least one container in such a way that contaminations can be reduced to an even greater degree. It can also be provided that the bulkhead is designed for transferring a plurality of containers in such a way that an arrangement can be used in a variety of applications.

The opening can likewise be designed in various ways, for example as a hole or as a portal or as a lock. The opening can also be designed to be closable, in particular when no transfer takes place. In this way, an even higher standard of hygiene can be achieved so that methods as described and/or claimed hereunder can be carried out even more reliably.

The container can also be designed in various ways. For example, a closed container opening can be designed as a predetermined breaking point or as a port. A container opening is in particular defined in that the container is opened at the container opening as is typical in the specific industry and customary at least in the usual method steps.

For example, the container can be closed using a sealing tab or a sealing layer, or be closable or closed using a plug or a crown cap or the like.

The container can be, for example, a rigid container such as a bottle or a box, or be a flexible container such as a bag. Other types of containers and shapes of containers can advantageously also be used.

In one advantageous design embodiment it can be provided that the at least one container for receiving by the second transport device is able to be positioned partially in the input region and partially in the output region. In the process, the opening can be almost closed by the at least one container during transfer, in particular when the dimension of the opening is adapted to a circumference of the at least one container. It can furthermore be advantageous that the container can be received by the second transport device without the second transport device having to reach into the input region. As a result, the risk of contamination can be reduced even more.

In one advantageous design embodiment it can be provided that the first transport device and/or the second transport device are/is positioned outside the opening. As a result, an opening can be optimally adapted to the at least one container because the dimensions of the transport devices do not influence the opening. The first and/or the second transport device positioned outside the opening can be disposed in such a way that a transfer can take place on a very short path, as a result of which processes can be rapidly performed.

Alternatively or additionally, it can be provided that the first and the second transport device do not protrude and/or reach through the opening. The first and the second transport device can be constructed and positioned in such a way that they do not make their way into a region located on another side of the opening, in particular not during transfer. For example, the first transport device cannot protrude and/or reach through the opening into the output region, this being particularly advantageous for sterile transfers in protected regions.

In one advantageous design embodiment it can be provided that the container opening and a base of the container are disposed on different sides of the opening when the container is gripped by the first transport device and the second transport device. As a result, a container can be transferred by a vertical movement, this being potentially advantageous in particular when the container is a container which is to be filled with a liquid, or is filled with a liquid.

Alternatively or additionally, it can be provided that the bulkhead is positioned between the gripping points of the first and of the second transport device. As a result, a particularly sterile transfer can take place because any potential wear debris resulting from the gripping action of the first and/or the second transport device cannot make its way through the opening of the bulkhead. This advantage is all the greater when the first and the second transport device do not protrude and/or reach through the opening, as has been described herein and/or is claimed hereunder.

In one advantageous design embodiment it can be provided that a pressure difference exists between the output region and the input region. In this way, the at least one container can be transported counter to a pressure drop between the input region and the output region, this being advantageous.

The opening here can preferably be disposed in such a way that the region of a lower pressure is below the opening. In this way, the input region can be formed as a region of lower pressure below the opening, for example. As a result, the at least one container can be transferred into the output region by a vertical movement without potential contaminations making their way into the output region. In this way, contaminations could not make their way through the opening due to the higher pressure of the output region, this being advantageous.

Alternatively or additionally, the input region and/or the output region can preferably be designed as part of a protected region. A container can be held in a particularly clean or sterile manner in this way.

In particular, the input region and/or the output region can be designed as part of an isolator or of a RABS. In this way, an arrangement can be used at least in sterile operations for producing pharmaceutical products and/or foodstuffs.

In one advantageous design embodiment it can be provided that the bulkhead is designed to be curved at least in a bulkhead region that comprises the opening. An air flow of a protected region can be positively influenced by a curvature of the bulkhead region in such a way that optimal venting prevails, in particular in an input region and/or output region of an isolator and/or RABS as described herein or claimed hereunder.

It can be provided in particular that the bulkhead protrudes into the input region and/or the output region. As a result, the bulkhead can protrude optimally into the input region and/or the output region, owing to which transport paths within these regions can preferably be shortened. As a result, an entire process, for example a filling process of a container, can be accelerated.

Alternatively or additionally, the at least one opening is formed in a horizontal and/or oblique and/or vertical portion of the bulkhead. In this way, an opening can be formed variably on a portion of a bulkhead, as a result of which a transport device, in particular the first and/or the second transport device described herein or claimed hereunder, can be designed in various ways. In this way, an arrangement can be utilized in various ways, which is advantageous.

Alternatively or additionally, the at least one opening can be adapted to the dimensions of the at least one container by a replaceable sheet-metal panel. In this way, an arrangement for transferring containers of various designs can be adapted, which is particularly user-friendly.

The sheet-metal panel can be replaced manually and/or automatically on the bulkhead, as a result of which a replacement of the sheet-metal panel can be carried out in a comparatively flexible manner, and if necessary in a sterile manner.

It can also be provided that the opening, when not used, can be tightly closed with a cover by an (automated or manual) closing procedure, so as to be able to even further minimize further transmissions of contaminations between the input region and the output region.

It can furthermore additionally or alternatively be provided that at least two containers are able to be simultaneously transferred through the at least one opening. In this way, more than one container can preferably be simultaneously transferred through the opening in an arrangement. A transfer of a plurality of containers can be particularly rapidly carried out in this way.

In one advantageous design embodiment it can be provided that the first and/or the second transport device are/is connected to the bulkhead. As a result, an output region and/or an input region can be designed in a particularly space-saving manner.

In particular, the first and/or the second transport device can be held by the bulkhead, which may simplify the construction of at least one of the two transport devices.

In one advantageous design embodiment it can be provided that at least one transport device is a mover which is magnetically coupled to a stator assembly. In this way, at least one transport device can transfer the at least one container without wear debris, this being particularly advantageous in protected regions of pharmaceutical production and/or in the foodstuff industry.

Any magnetic coupling known to a person skilled in the art is understood to be a magnetic coupling of the mover to the stator assembly. The stator assembly herein can be specified to generate a magnetic field which is variable in a controlled manner and levitates and/or moves the mover.

In this way, a magnetic coupling can be implemented by an electromagnetic coupling of the mover to the stator assembly. The stator assembly here can comprise at least one solenoid. The mover can have, for example, at least one permanent magnet, or be designed to be magnetically active and/or responsive in another way.

Alternatively or additionally, the stator assembly as well as the mover can in each case comprise at least one permanent magnet. A movement of the mover here can in particular be initiated, terminated and/or controlled by changing the magnetic field which is formed by the stator assembly. The stator assembly can thus comprise in particular movable permanent magnets which are operatively connected to the mover and/or can be brought to operatively connected to the latter. The movable permanent magnets can be driven by a motor, for example. In this way, a magnetic field which is variable in a controlled manner and which can be used for driving a movement of the movers is able to be generated by a controlled movement of the permanent magnets.

It can furthermore be provided, for example, that the stator assembly is designed with at least one electro-permanent magnet.

The magnetic coupling serves in particular to implement a relative movement, a positioning and/or an orientation of the mover relative to the stator assembly in a controlled manner.

It can be provided here that a transport device consists of more than one mover, preferably of two movers, which are able to be coupled to one another. In this way, the at least two preferably intercoupled movers can implement a reliable transfer, in particular when an item to be transferred is particularly heavy. For example, a mover can be characterized as a unit which is inductively coupled to and levitated by a developed or planar stator assembly. Positioning and/or driving can be achievable, for example, by correspondingly energizing the stator assembly.

It can furthermore be provided that the at least one mover is movable at least in two degrees of freedom, in particular in more than two degrees of freedom. In this way, the transport device can have a high level of mobile flexibility.

In one advantageous design embodiment it can be provided that the at least one container is able to be transferred into the output region by a movement with at least one vertical and/or at least one horizontal component of the first and/or of the second transport device. In this way, a container can be transferred into the output region by a multiplicity of motion components, so that an arrangement for transferring at least one container can be installed and utilized in a multiplicity of production sites.

In one advantageous design embodiment it can be provided that the opening is aligned between a high pressure side and a low pressure side in such a way that a resultant air flow through the opening assumes an angle of less than 90° in relation to an air flow running vertically from top to bottom. In particular, an air flow exiting the opening can thus assume an angle which is less than 90° in relation to an imaginary vertical line extending through the opening. In this way, a unidirectional air flow between two regions, preferably between the aforementioned output region and input region, can be achieved, as a result of which undesirable turbulence flows, or swirling, can be prevented. Owing to this fact, an undesirable transfer of, for example, high-potent products from the low pressure side to the high pressure side can be avoided.

In one advantageous embodiment, which has an independent inventive character, it can be provided that in the arrangement the first transport device described herein, or a first transport device, and the second transport device described herein, or a second transport device, for transferring the container described herein, or a container, are designed with a preferably closable or closed container opening, wherein the first transport device and the second transport device are designed in such a way that the at least one container is able to be gripped by the first transport device at an identical and/or a different distance from the container opening to/than by the second transport device, wherein the design embodiment is characterized in that the container is gripped by the first and the second transport device, and a plane extending through the container or intersecting the container is positioned between the gripping points of the first and of the second transport device. In this way, the plane is positioned at least between the gripping points, preferably between the transport devices. For example, the plane can be positioned in the opening during transfer. A transmission of contaminations from the first to the second transport device, in particular during transfer, can be reduced or even prevented in such a way that a dissemination of contaminations within the input region described herein, or within the output region described herein, or between the input region and the output region as described herein, is decelerated or even prevented.

It is furthermore advantageous in the embodiment that as a result of the plane, alternatively or additionally the first and the second transport device do not protrude and/or reach through the plane, for example in the opening described herein.

The plane is particularly preferably a mirror plane of the container. In this way, advantageously and as is in particular provided, the first transport device and/or the second transport device can be positioned outside the opening. The first transport device and/or the second transport device can be positioned at a sufficient spacing from the container and/or the opening.

It can be advantageous for stable gripping, in particular in the case of large containers, for example dispensing devices, when the at least one container is designed to be able to be gripped, or is gripped, by the first transport device at an identical distance from the container opening to by the second transport device.

It can be advantageous for contamination-free transfer of containers when the at least one container is designed to be able to be gripped, or is gripped, by the first transport device at a different distance from the container opening than by the second transport device.

In a particularly preferred design embodiment it can be provided that the first and/or the second transport device comprise the mover described herein, as a result of which a transfer can be carried out particularly free of contamination, because the movers can be moved without wear debris and in a flexible manner, preferably in more than two degrees of freedom.

In one advantageous design embodiment it can be provided that the arrangement comprises at least one monitoring unit. A transfer can be monitored in this way. This is particularly advantageous when at least one transport device comprises at least one mover as described herein. In this way, it can be reliably verified by the monitoring unit whether a transfer of the at least one container has taken place in an orderly manner.

The monitoring unit can be attached and/or positioned anywhere in or on the arrangement. The type and design of the monitoring unit is known to the person skilled in the art.

Alternatively or additionally, it can be provided that the at least one monitoring unit is formed on the first and/or the second transport device. In this way, monitoring of the transfer can take place close to the transfer location, in particular close to the container described herein and/or close to the gripping points or gripping elements described herein, so that monitoring can be designed to be particularly accurate.

For achieving the object mentioned, one or more of the features of disclosed herein directed toward a filling device are alternatively or additionally provided according to the invention. In order to achieve the object mentioned in a filling device of the type described at the outset it is thus in particular proposed according to the invention that a pressure difference in relation to the or an input region exists in the or an output region. Containers can be filled or topped up in a particularly sterile manner by using a filling device according to the invention. Owing to the pressure difference between the output region, in which the filling device is positioned, and the input region, from which the at least one container is able to be transferred into the output region, a particularly high level of contamination prevention of the container, or of a liquid located in the container, is achieved. Furthermore, the pressure difference mentioned can reduce or even prevent any unintentional dissemination of a leaking, in particular toxic, liquid (high-potent products) from the output region, which can protect in particular a protected region and/or a workforce as described above. In this way, the filling of containers in a protected region can be improved.

The filling of containers in a protected region can in particular be improved when the filling device is positioned in an output region of an arrangement as described herein or claimed hereunder. In this way, the container can be particularly advantageously transferred into the output region. It can be the case that the second transport device described herein, or claimed hereunder, transports the container to the filling device and/or positions the container at the filling station, as a result of which the transfer process can preferably be structurally coupled to the filling process, as a result of which an overall filling process can be particularly protected and rapid.

A filling station can be characterized as a location at which filling takes place, for example. A filling device according to the invention can advantageously comprise a bulkhead, for example the above-mentioned bulkhead, or a portion of the bulkhead. In this way, containers customary in the pharmaceutical industry can preferably be filled.

In one advantageous design embodiment it can be provided that the at least one filling station is positioned on a high pressure side. It can be prevented as a result that contaminations make their way to the filling station, owing to which fact a filling process can be carried out in a particularly sterile manner.

Alternatively, the at least one filling device can be positioned on a low pressure side. It can be ensured in this way that in particular toxic substances (high-potent products) cannot leave the output region. As a result, an increased level of safety in terms of the environment and the workforce can be guaranteed.

In one advantageous design embodiment it can be provided that the output region described herein or claimed hereunder, or an output region, is contiguous to a process chamber, wherein a pressure difference exists between the output region and the process chamber. In this way, a preferably filled container can be safely transferred into a process chamber, wherein in particular the filling station and/or an environment outside the output region can be protected in an advantageous manner from any leaking liquid.

The abovementioned pressure difference preferably has the same algebraic sign as the pressure difference between the output region and an, in particular the input region mentioned herein or claimed hereunder. "Same algebraic sign" here preferably means that the pressure difference can be a pressure drop (negative) or a pressure increase (positive) between the output region and the input region and/or the process chamber. In this way, a filling station, or the output region, or an environment outside the output region, can be particularly effectively protected from any leaking liquid.

For achieving the object mentioned, one or more of the features disclosed herein directed toward a method are alternatively or additionally provided according to the invention. In particular, in order to achieve the object mentioned in a method of the type described at the outset it is therefore proposed according to the invention that the container for transferring is gripped by the first transport device at a different distance from the container opening than by the second transport device, in particular wherein the container is gripped simultaneously and/or successively by the first transport device and the second transport device. In this way, the first and the second transport device can grip a container flexibly so as to enable transfer and without impeding one another. Due to the two transport devices gripping at different distances from the container opening, the at least one container can be transferred in a stable and more rapid manner, as a result of which transfers of containers can be improved.

Owing to the separation of the input region from the output region by the bulkhead, the two regions can be kept sterile, or a transmission of contamination between the two regions can be reduced, respectively. Due to the first and the second transport device gripping at different distances from the container openings, a transmission of contamination can be even more reduced or even avoided.

Not only the input region and the output region can remain protected from contaminations by a method according to the invention, but also the container and a content located therein, for example a pharmaceutical product or a foodstuff. This can be achieved in particular in that the first and the second transport device grip at a distance from the container opening, so that no wear debris makes its way into or onto the container opening, for example.

A method according to the invention is in particular advantageously carried out while using an arrangement as has been described herein or is claimed hereunder.

Simultaneous and/or successive gripping of the container by the first and the second transport device advantageously enables a flexible and effective transfer of containers. In this way, the containers can be gripped simultaneously or successively by the first and the second transport device, depending on a container dimension.

In one advantageous design embodiment of the method it can be provided that the first transport device and/or the second transport device remain outside the opening at least during transfer. In this way, a method can be carried out in a particularly sterile manner. It can furthermore be advantageous that the first and/or the second transport device do not collide with one another and/or with a periphery of the opening, so that a method can be particularly accident-proof.

In one advantageous design embodiment of the method it can be provided that at least two containers are transferred, wherein the at least two containers are not singularized during transfer. In this way, a plurality of containers can advantageously be transferred, as a result of which a processing rate can be accelerated.

It can furthermore be advantageously provided that the containers are simultaneously transferred, preferably through an opening. In this way, a processing rate can be particularly fast.

It can in particular be advantageously provided that the at least two containers are not singularized by the second transport device.

In one advantageous design embodiment of the method it can be provided that at least two containers are transferred, wherein each container is individually gripped by the second transport device. As a result, singularizing the containers can be carried out during transfer. In this way, transporting or further processing of the containers can be flexibly designed.

When singularizing as described above, it can be provided that different containers are subjected to different transport paths and/or further processing steps. This can be advantageous in the case of wrongly filled and/or damaged containers which have to be removed after transfer. In this way, singularizing the containers during transfer can particularly advantageously serve as a safety measure for increasing process quality.

In one advantageous embodiment, having an individual inventive character, it can be provided in a method for transferring a container provided with a container opening that the container is held by the first transport device in particular as described herein, or by a first transport device, and the container is transferred to the second transport device in particular as described herein, or to a second transport device, wherein at least the first and/or the second transport device are/is designed as the mover described herein, or as a mover, in particular wherein the container for transferring is gripped by the first transport device at an identical and/or at a different distance from the container opening to/than by the second transport device and/or wherein the container is gripped simultaneously and/or successively by the first transport device and the second transport device. In this way, the first and the second transport device, as described above, can grip a container flexibly so as to enable transfer and without impeding one another.

Furthermore, a transfer can advantageously take place without any transmission of contaminations in the arrangement, thus for example in the output region or input region described herein.

A transfer can be carried out efficiently and flexibly by using at least one mover. By using a mover in the first and/or the second transport device, the transfer can be designed without wear debris, as a result of which the dissemination of contaminations in the arrangement can also be minimized. When the first and the second transport device are magnetically levitated, they can be displaceable on a common drive surface, or on mutually separate drive surfaces. In this way, a transfer can be carried out variably in the arrangement, even when the first and the second transport device are disposed or displaceable in other regions and/or drive surfaces.

The transfers are particularly advantageous when the first and/or the second transport device are additionally used for transferring a container provided with a container opening from an input region into an output region, in particular while using an arrangement described herein, wherein the container in the input region is held by a first transport device, and the container is transferred to a second transport device, which is disposed in the output region, through an opening in a bulkhead, wherein the container for transferring is gripped by the first transport device at a different distance from the container opening than by the second transport device. In this way, a material flow, thus in particular the transport of the at least one container, within different regions and/or between two arrangements can be particularly improved, because the respective transfers between the first and second transport devices are improved.

In a particularly advantageous design embodiment of the method it can be provided that the container is gripped by the first and the second transport device, wherein the first transport device and/or the second transport device at least during transfer do/does not protrude or reach through the or a plane extending through the container or intersecting the container. The first and the second transport device can be constructed and positioned in such a way that they do not make their way into a region located on another side of the plane, in particular not during transfer. In this way, the first transport device cannot protrude and/or reach through the plane into the region behind the container (when seen from the first transport device), for example, this being particularly advantageous for sterile transfers in protected regions.

In one advantageous design embodiment of the method it can be provided that the method for transferring is monitored. In this way, it can advantageously be monitored whether and how the transfer has taken place, so that a transfer quality can be evaluated.

The monitoring is in particular carried out by at least one monitoring unit formed on the first and/or the second transport device. In this way, the monitoring can be carried out close to the region of a transport device, in particular of a mover.

Alternatively or additionally, the monitoring can be carried out at a monitoring unit which is designed to be stationary, for example a 3D camera. In this way, a monitoring unit can be placed optimally in the arrangement.

In one advantageous design embodiment of the method it can be provided that the at least one container is transferred into the output region by a movement with at least one vertical and/or with at least one horizontal movement component of the first and/or of the second transport device. As a result, the at least one container can be transferred into the output region by a multiplicity of motion components in such a way that a method can be flexibly adapted to a region, preferably to a protected region as described herein or claimed below, which may be advantageous to a user.

A flexible method as has just been described is also able to be implemented when at least two containers are transferred.

Alternatively or additionally it can be provided that at least one mover, which is magnetically coupled to a stator assembly, is used as the first and/or the second transport device. In this way, a transfer can be carried out without friction, as a result of which a method can be designed with a long service life. Also, a protected region can be kept clean and free of contamination in this way, as a result of which a method can be maintenance friendly and/or cost effective.

In one advantageous design embodiment of the method it can be provided that the at least one container for filling is transported to a filling device as described herein or claimed hereunder. As a result, the container can be moved by the second transport device to the filling device in a particularly time-saving and effective manner. In particular when the second transport device is part of an arrangement mentioned herein or claimed hereunder, transferring and filling can thus be particularly sterile and/or safe for the workforce.

It can furthermore be advantageously provided that an arrangement described and/or claimed herein, and/or a method described and/or claimed herein, is used in an aseptic fill-finish method and/or in an aseptic fill-finish production plant. In this way, an aseptic fill-finish method and/or an aseptic fill-finish production plant can be improved, in particular by the arrangement described herein and/or by the method described herein.

The use is particularly advantageous when, as can be provided, the arrangement described herein and/or the method described herein comprise/comprises a filling device described herein.

According to a further aspect of a potentially independent inventive quality it can be provided that at least one magnetically levitated transport device, which is movable on a non-vertical drive surface which extends in particular at an angle in relation to a vertical direction, for example a horizontal drive surface, for transporting a workpiece from a first processing station to a second processing station is used.

The workpiece can be, for example, a container, or have a container, in particular as described above.

For example, this aspect can be embodied and/or used within a controlled environment, for example within an isolator.

It can be provided here that the first and the second processing station are located in an arrangement as described and/or claimed herein. Transporting the workpiece to the second processing station in an arrangement as described and/or claimed herein can thus advantageously take place. The transport here can at least partially use the methods for transfer described and/or claimed herein, in order for the transport of the workpiece from the first to the second processing station to be implemented.

It can also be provided that the first processing station is located in a first arrangement as described herein, and the second processing station is located in a first arrangement as described herein. In this way, transporting the workpiece to the second processing station can advantageously take place between two arrangements as described herein.

Furthermore, it can be provided particularly and advantageously that the at least one magnetically levitated transport device, which is movable on a horizontal drive surface, is designed as a first and/or second transport device as described and/or claimed herein. In this way, a transfer of the workpiece between the two transport devices, in particular as described and/or claimed herein, and/or between the transport device and the first and/or the second processing station, can advantageously be carried out during transport.

A processing station can in particular be a filling device as described and/or claimed herein, or else a closing station, a testing station or an analyzing station for analyzing a preferably mass-dependent or volume-dependent or quantity-dependent parameter of the workpiece and/or of the transport device (e.g. measuring weight by a balance).

A processing station, in particular one located outside the arrangement, can be a labeling station or a crimping station.

BRIEF DESCRIPTION OF THE DRAWINGS

The invention will now be described in more detail by means of exemplary embodiments but is not limited to these exemplary embodiments. Further exemplary embodiments are derived by combining the features of individual or of a plurality of claims with one another, and/or with individual or a plurality of features of the exemplary embodiments.

In the figures.

DETAILED DESCRIPTION

Figure 1:
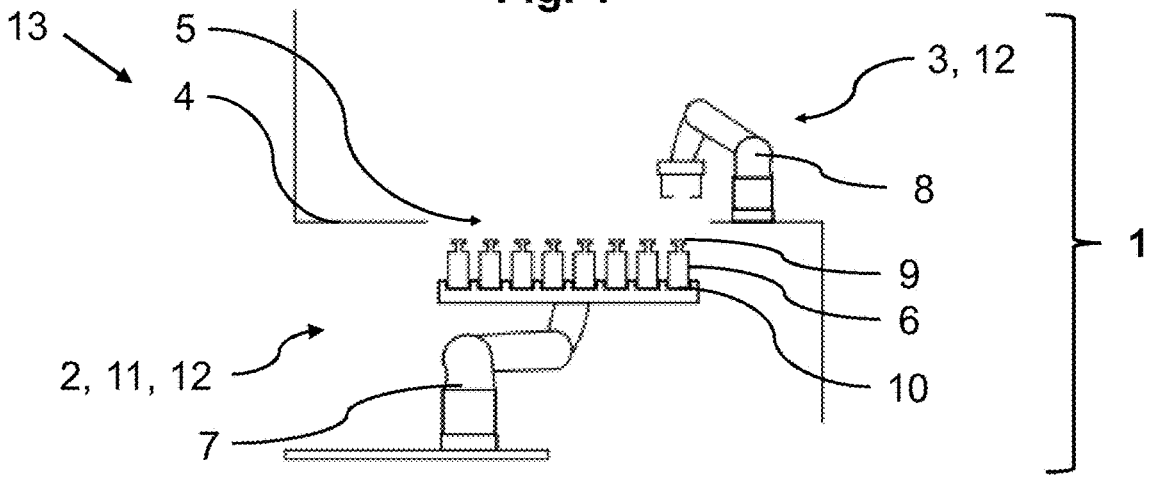
FIGS. 1 to 3 show a method according to the invention using an arrangement according to the invention.
Figure 2:
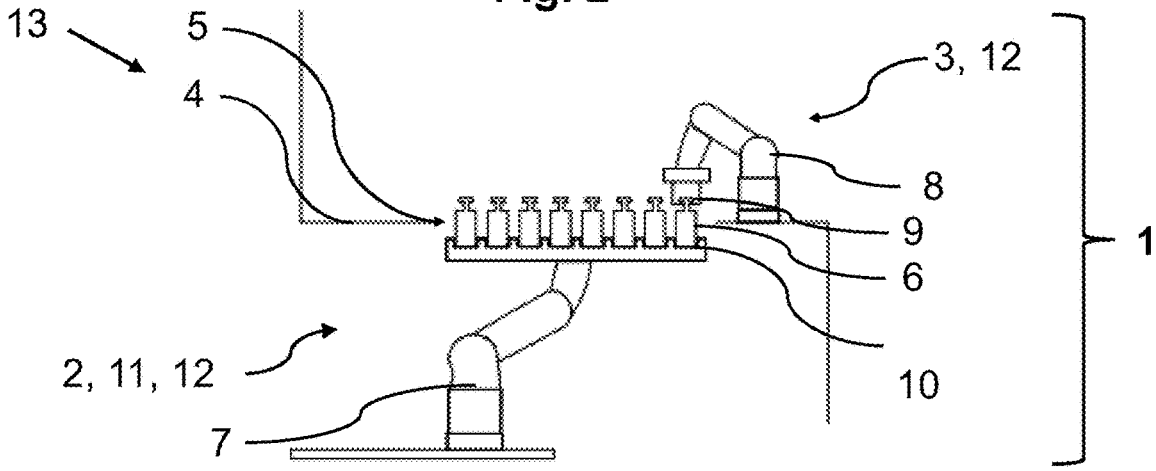
Figure 3:
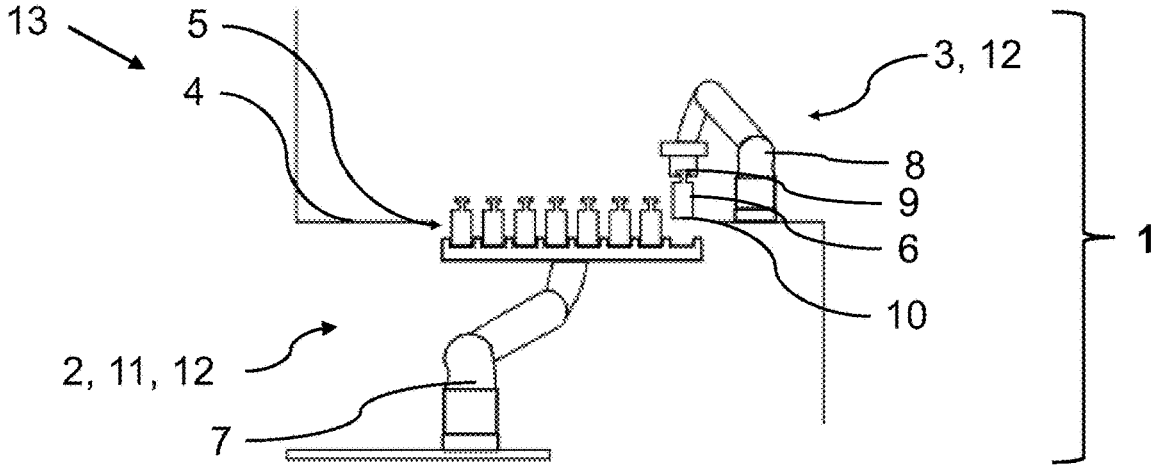

FIGS. 1 to 3 show a method according to the invention using an arrangement 1 according to the invention, which is in each case illustrated in the cross section and will be described hereunder.

The arrangement 1 has an input region 2 and an output region 3 which are mutually separated by a bulkhead 4. The input region 2 as well as the output region 3 are designed as a protected region 12 of an isolator 13 such as can preferably be found in the pharmaceutical industry or in the production of foodstuffs. Thus, an arrangement 1 can alternatively be used in a RABS or in similar cleanrooms. However, the use of an arrangement 1 according to the invention is not limited to cleanrooms.

In a method according to the invention, as can be carried out by the arrangement 1 illustrated in FIGS. 1 to 3, and as will yet be described later, eight containers 6 are able to be transferred. However, it is conceivable that any other number of containers 6 can be transferred by an arrangement 1 and/or by a method according to the invention.

The input region 2 has a first transport device 7, wherein the first transport device 7 is designed as a robotic arm which is positioned so as to be spaced apart from the bulkhead 4. In contrast, the output region 3 has a second transport device 8 which by way of example is designed as a gripper arm and is positioned and secured on the bulkhead 4. Both transport devices 7, 8 are positioned outside the opening 5.

The first and the second transport device 7, 8 can be flexibly positioned in the input region 2, or in the output region 3, respectively. For example, FIGS. 13 to 16, and FIGS. 17 to 20, show in each case alternative arrangements 1 in which the two transport devices 7, 8 are not positioned on the bulkhead 4. In these arrangements 1 it is provided that at least one transport device 7, 8, preferably the first and the second transport device 7, 8, are designed so as to be variable in terms of their location in relation to the opening 5 of the bulkhead 4. As a result, a particularly high level of flexibility when transferring containers can be implemented.

It is shown in FIG. 2 that the eight containers 6 in the opening 5 of the bulkhead 4 are gripped by the first transport device 7 at a different distance from the container opening 9 than by the second transport device 8. In this way, the first transport device 7 grips the eight containers 6 at their bases 10, and the second transport device 8 receives each container 6 individually just below the container opening 9 of the latter. Furthermore, the eight containers 6 for receiving by the second transport device 8 are advantageously positioned partially in the input region 2 and partially in the output region 3.

It can furthermore be seen from FIG. 2 that the bulkhead 4 is positioned between the gripping points 31 of the first and of the second transport device 7, 8; this is because, as has been explained in the preceding paragraph, the first transport device 7 grips the eight containers 6 at their bases 10, and the second transport device 8 receives the containers 6 just below the container openings 9 of the latter. In this way, a transfer of containers 6 can be carried out by the arrangement 1 so as to be particularly free of contaminations of the containers 6 and/or of the protected regions 12. The transfer here is improved and less prone to contamination because the input region 2, or preferably the region below the opening 5, is designed as a region 11 of a low pressure. In this way, an undesirable transmission into the output region 3, which has a higher pressure than the input region 2, and wherein an air flow 23 at the opening 5 can be less turbulent, during transfer can be reduced or even avoided.

The differences of the alternative arrangements 1 of FIGS. 4 to 29 in comparison to the arrangement 1 of FIGS. 1 to 3 will be described hereunder. Components and functional units which are equivalent or identical to the preceding exemplary embodiment in terms of function and/or construction are provided with the same reference signs and are not described again separately. The explanations pertaining to FIGS. 1 to 3 therefore apply in an analogous manner to FIGS. 4 to 29.

Figure 4:
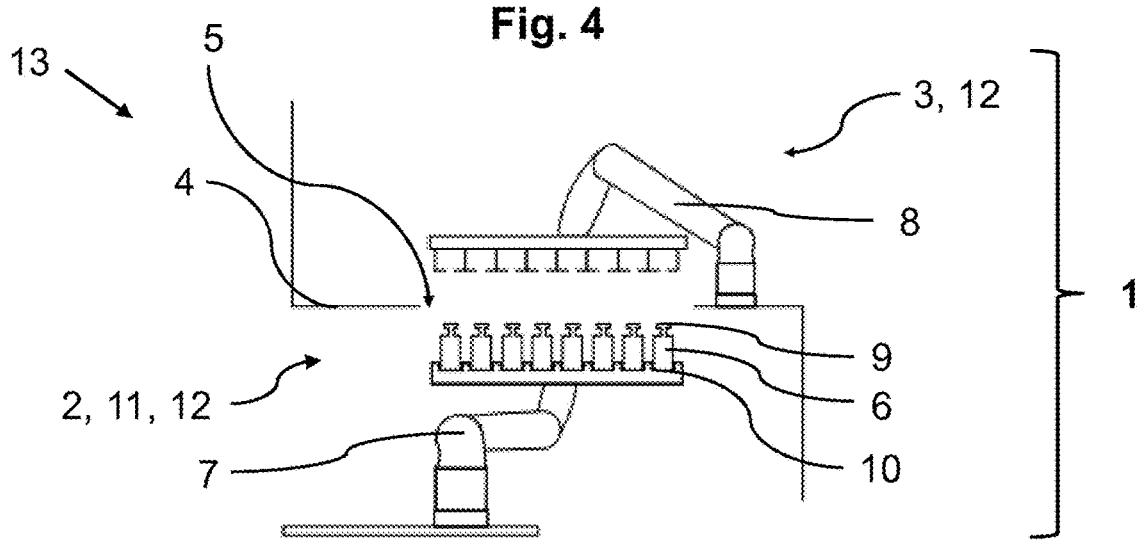
FIGS. 4 to 6 show a method according to the invention using a first alternative embodiment of an arrangement according to the invention.
Figure 5:
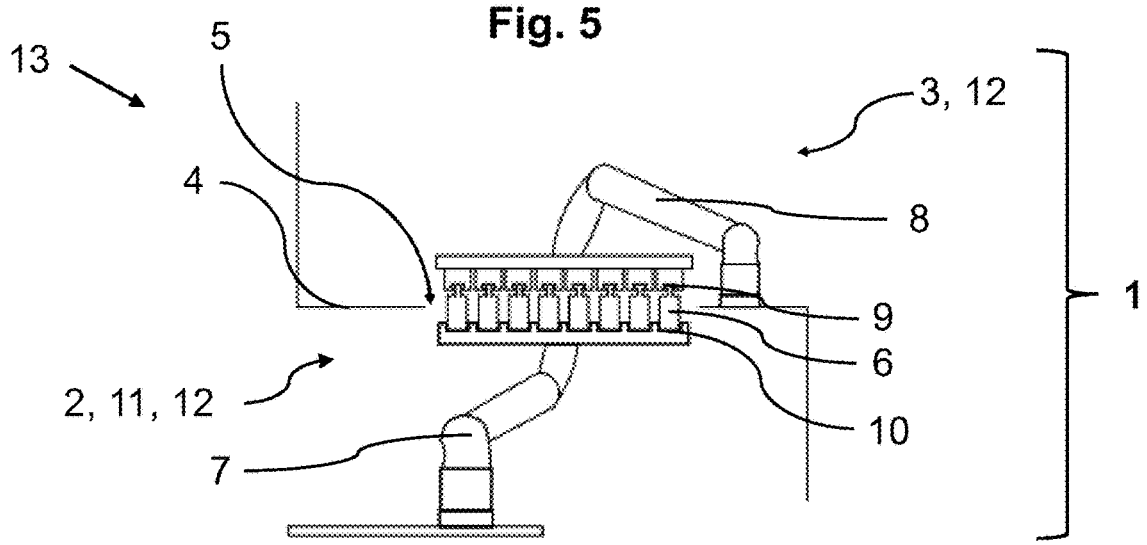
Figure 6:
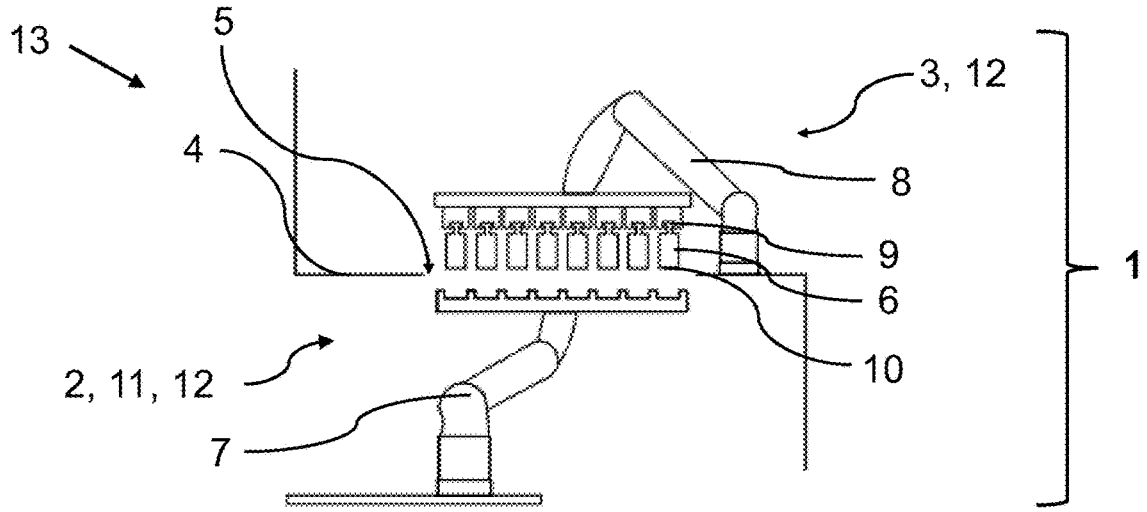
Figure 7:
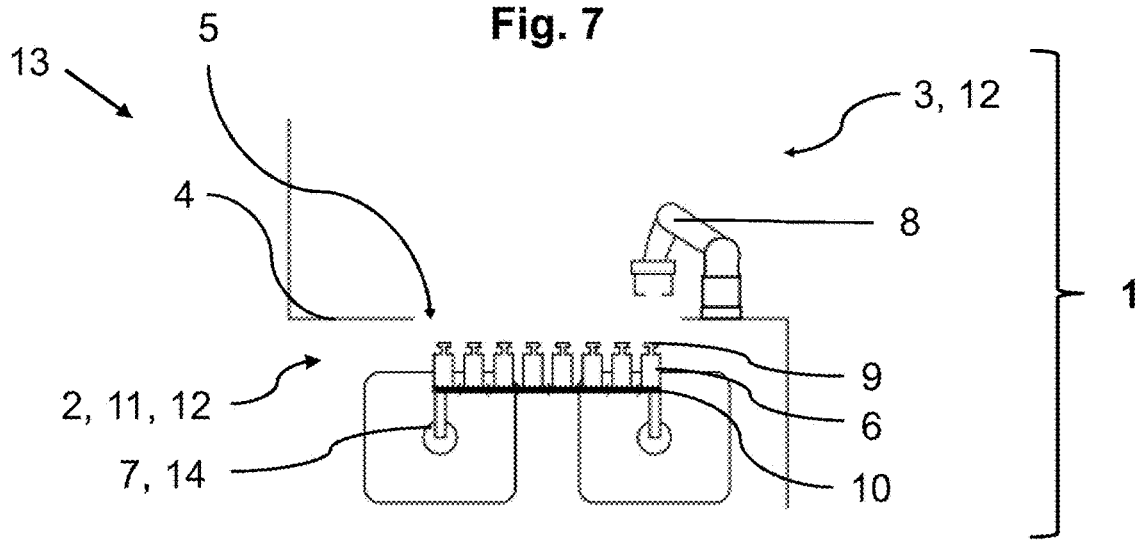
FIGS. 7 to 9 show a method according to the invention using a second alternative embodiment of an arrangement according to the invention.
Figure 8:
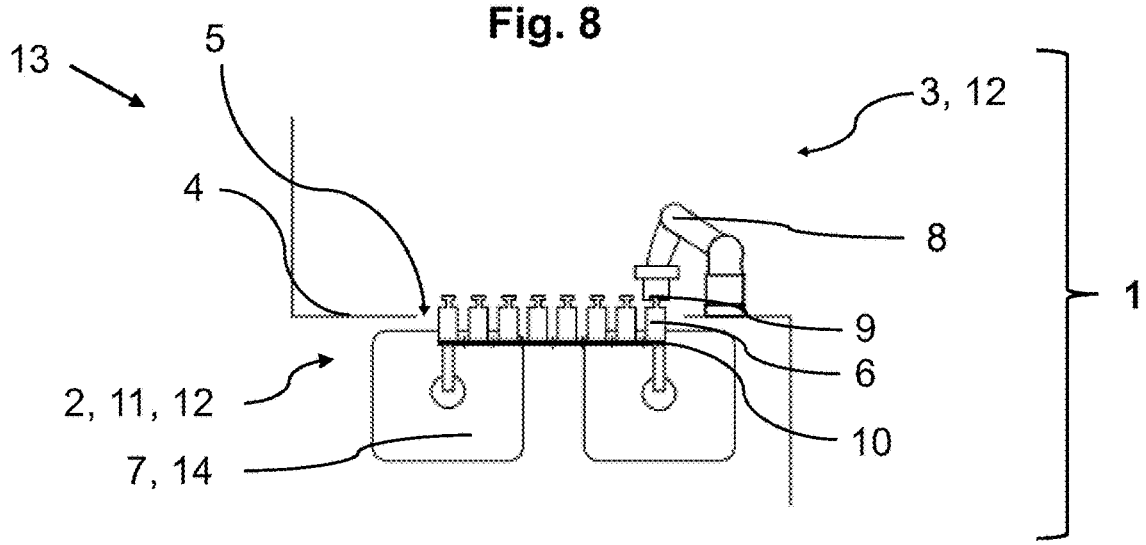

The arrangement 1 according to FIGS. 4 to 6 differs from the preceding exemplary embodiment at least in that the eight containers 6 are not singularized by the second transport device 8 during transfer (FIG. 5) but are able to be conjointly transferred into the output region 3 (FIG. 6).

Likewise, the alternative arrangements 1 shown in FIGS. 10 to 12, 13 to 16, 17 to 20, 25 to 28 and 29 are designed in such a way that the containers 6 are not singularized during transfer.

Alternative arrangements 1, which are designed for singularizing the containers 6 during transfer, can be seen in FIGS. 7 to 9 and 21 to 24.

However, an arrangement 1 can also be designed in such a way that the second transport device 8 receives part of the containers 6, in particular at least two containers 6, gripped by the first transport device 7, so that a transfer can be able to be carried out in steps (not shown), which may advantageously accelerate a transfer.

Figure 29:
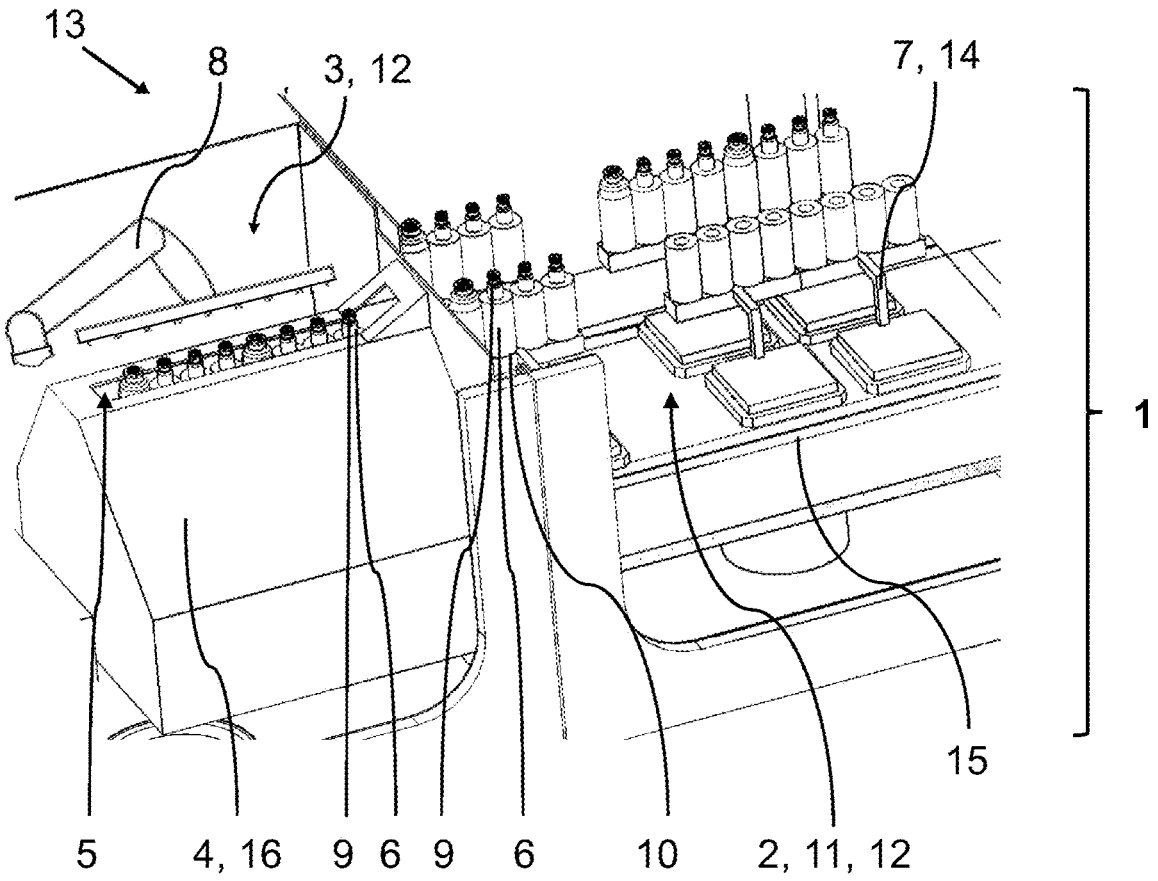
FIG. 29 shows an arrangement according to the invention having a curved bulkhead which protrudes into the output region.

The alternative arrangements 1 according to FIGS. 7 to 9, 10 to 12 and 29 differ from the preceding exemplary embodiments at least in that the first transport device 1 has two movers 14 which are magnetically coupled to a stator assembly 15, wherein the stator assembly 15 is attached to a wall and/or to a floor and/or a face of the isolator 13. A stator assembly 15 of this type is illustrated in FIG. 29. The containers 6 are positioned on a receptacle.

The alternative arrangements 1 according to FIGS. 13 to 16 and 17 to 20 differ from the preceding exemplary embodiments at least in that the first as well as the second transport device 7, 8 have movers 14 which are coupled to a stator assembly 15.

The alternative arrangements 1 according to FIGS. 21 to 24 and 25 to 28 differ from the preceding exemplary embodiments at least in that the first transport device 7 is designed as an elevator which prior to the transfer receives the containers 6 from a third transport device 17. The second transport device 8 can preferably be designed as a mover 14 which is coupled to a stator assembly 15 (not shown). The third transport device 17 can be designed as any transport device known to the person skilled in the art.

The alternative arrangement 1 according to FIG. 29 differs from the preceding exemplary embodiments at least in that the bulkhead 4 is designed to be curved in a bulkhead region 16 comprising the opening 5, and protrudes into the output region 3.

A method according to the invention for transferring a container 6 provided with a container opening 9, which method can be carried out by an arrangement 1 described above or claimed hereunder, could proceed as follows.

Containers 6 in an input region 2 are transported to an opening 5 of a bulkhead 4. Transporting the containers 6 within the input region 2 can take place exclusively by the first transport device 7. It can also be provided that at least one motion component which is independent of the first transport device 7 initially transports the containers 6 in the input region 2. In this way, it can be provided that a third transport device 17 transports the containers 6 to the first transport device 7 (FIGS. 21 and 25) before the containers 6 are transferred. Thus, an arrangement 1 can be particularly flexibly adapted to protected regions 12, as a result of which an arrangement 1 can also be subsequently installed in already existing isolators 13.

In any case, the containers 6 are held by the first transport device 7 and transferred through an opening 5 in the bulkhead 4, wherein the input region 2 and the output region 3 are separated by the bulkhead 4. Furthermore, the containers 6 for transferring are gripped by the first transport device 7 at a different distance from the container opening 9 than by the second transport device 8 (FIGS. 2, 5, 8, 11, 14, 15, 18, 19, 23, 27). In this way, transfer of containers 6 with a container opening 9 can be carried out in a particularly efficient and contamination-free manner.

A method, as illustrated in the alternative embodiments of FIGS. 2, 5, 8, 11, 14, 15, 18, 19, 23, 27, can be improved in that, for example, the first transport device 7 and the second transport device 8 remain outside the opening 5 at least during transfer.

Figure 9:
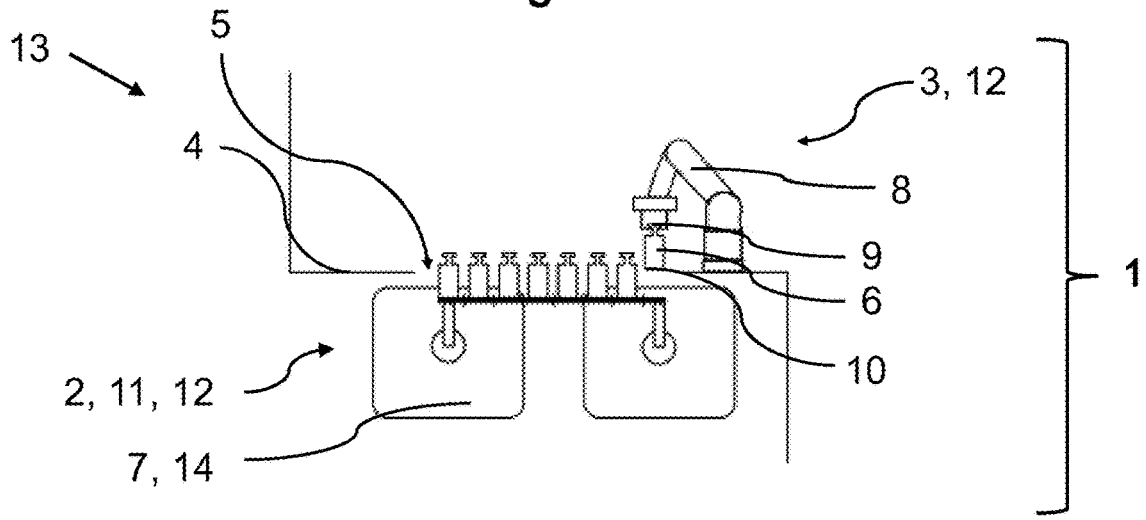
Figure 10:
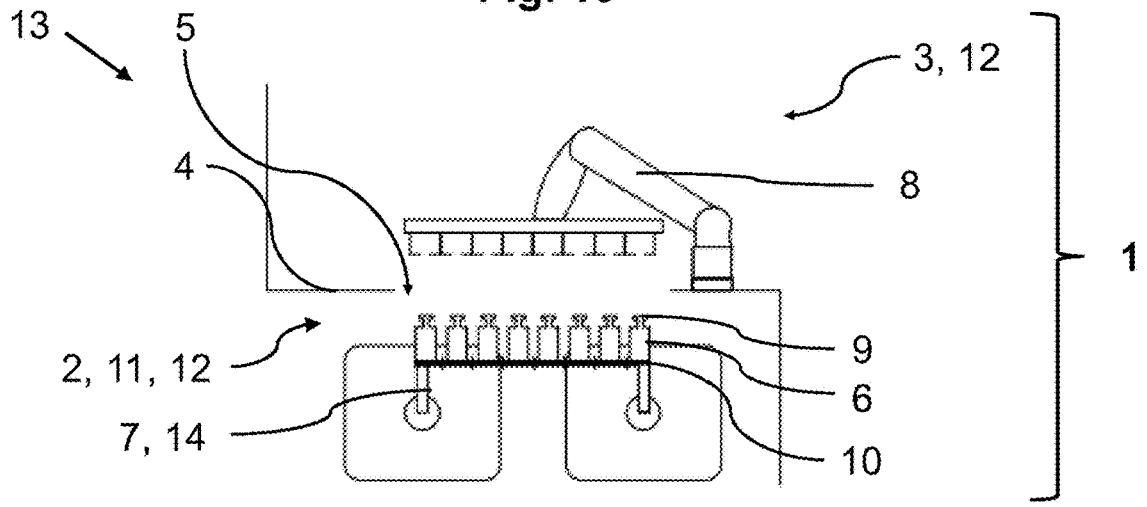
FIGS. 10 to 12 show a method according to the invention using a third alternative embodiment of an arrangement according to the invention.
Figure 11:
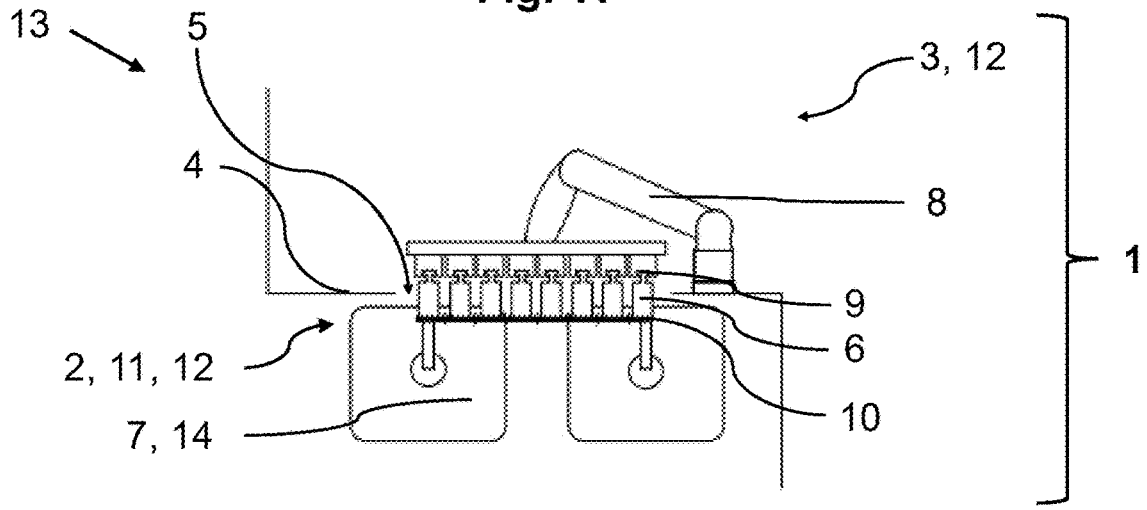
Figure 12:
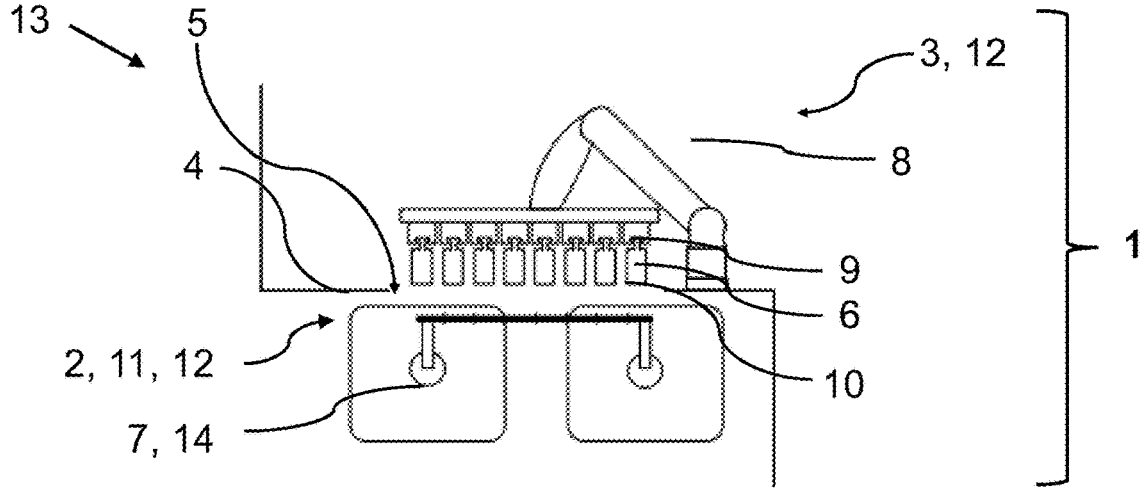
Figure 13:
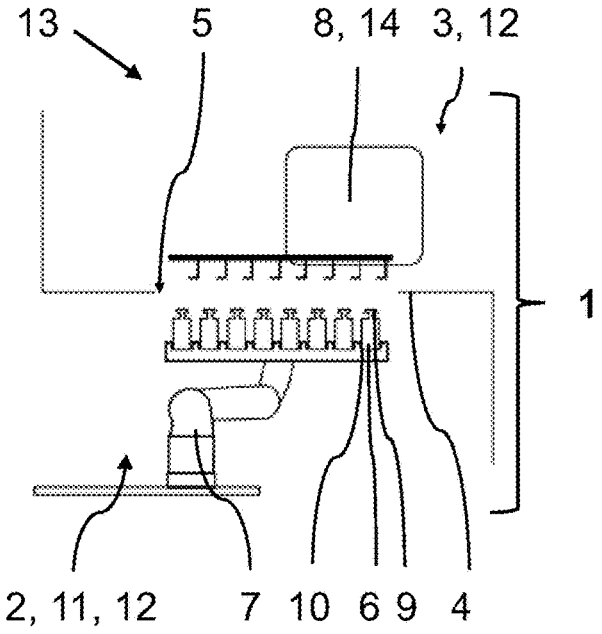
FIGS. 13 to 16 show a method according to the invention using a third alternative embodiment of an arrangement according to the invention.
Figure 14:
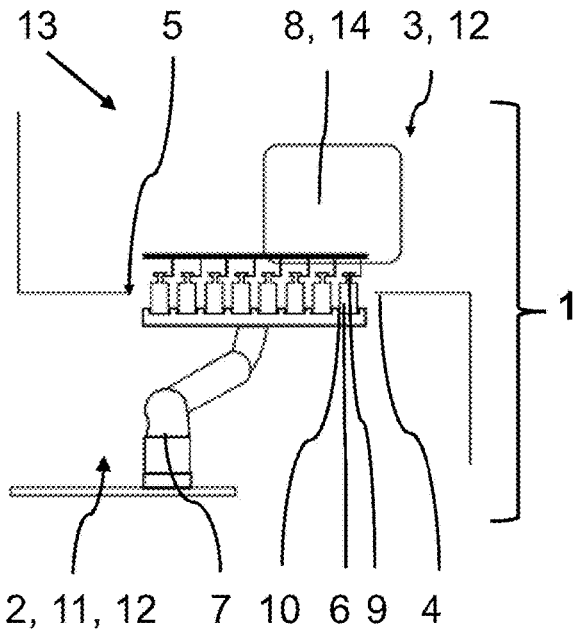
Figure 24:
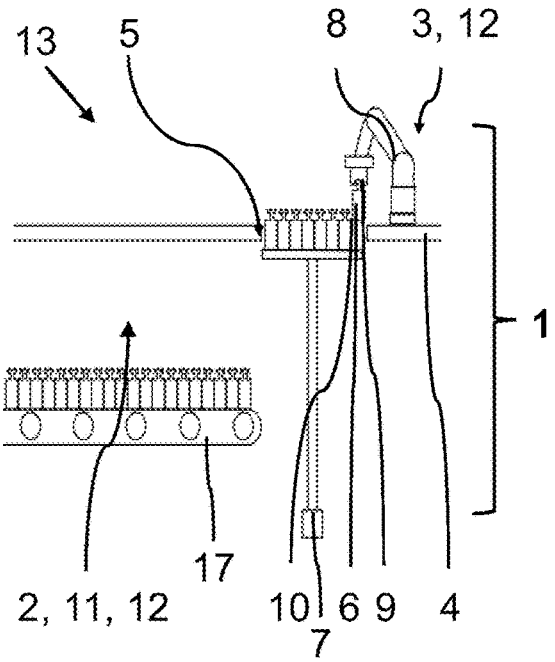
Figure 25:
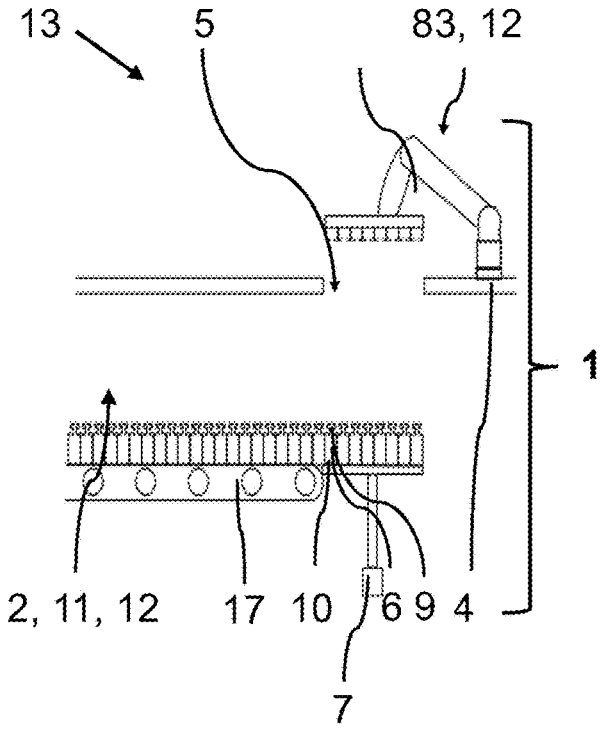
FIGS. 25 to 28 show a method according to the invention using a sixth alternative embodiment of an arrangement according to the invention.
Figure 26:
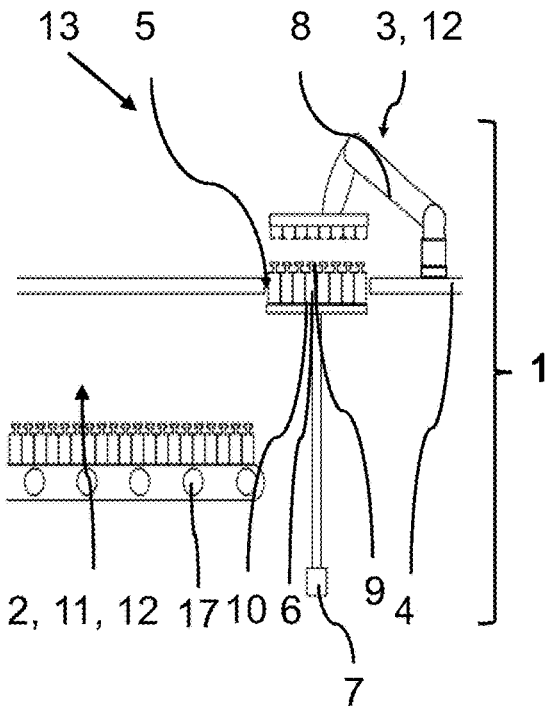
Figure 27:
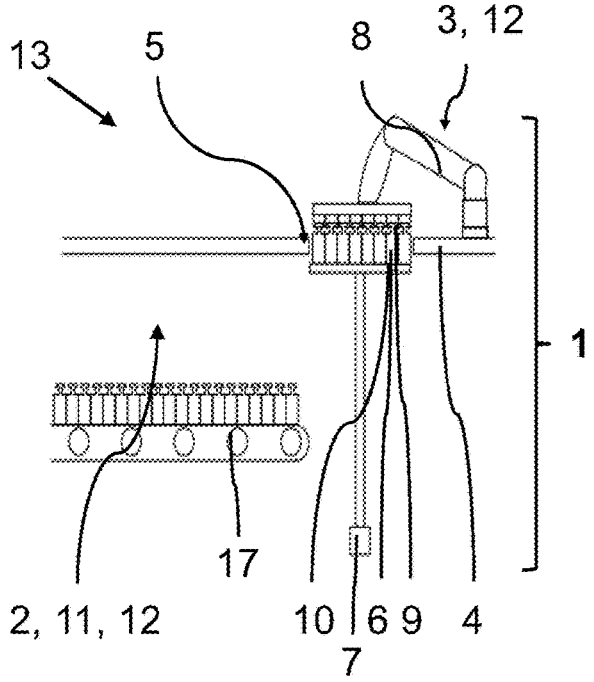
Figure 28:
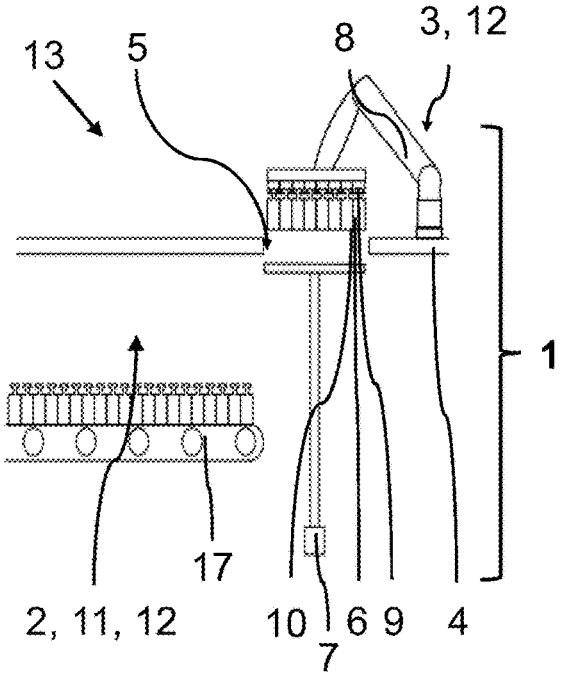

Containers 6 can be singularized or not singularized during transfer, depending on the method. In this way, conjoint receiving of the containers 6 in the output region 3 can be carried out by the second transport device 8 (FIGS. 6, 12, 16, 20, 28). Alternatively or additionally, a second transport device 8 can also be designed in such a way that, in a method for transferring containers 6 with a container opening 9, the containers 6 are transferred so as to be singularized (FIGS. 3, 9, 24).

Furthermore, the alternative methods of FIGS. 1 to 29 disclose that the at least one container 6 is transferred into the output region 3 by a movement with at least one vertical motion component of the first and of the second transport device 7, 8.

In a method according to FIGS. 1 to 31, the container 6 can be gripped simultaneously and/or successively by the first transport device 7 and the second transport device 8.

The embodiment according to FIG. 29 furthermore shows that the at least one container 6 can be transferred into the output region 3 by a movement with at least one horizontal motion component of the first transport device 7.

A motion component can not only be implemented horizontally or vertically but can carry out further motion sequences known to the person skilled in the art. In this way, for example a pivoting movement, a rotating movement or a diagonal movement for transfer may also be implemented in a method according to the invention and/or in an arrangement 1 according to the invention.

A method according to the invention, as is shown in the alternative embodiments of FIGS. 7 to 9, 10 to 12, 13 to 16, 17 to 20 and 29, is preferably carried out by at least one transport device 7, 8 which is designed as a mover 14 that is magnetically coupled to a stator assembly 15. In this way, a transfer can be particularly improved, in particular in a protected region 12, because the movers 14 during transfer hardly produce any wear debris that could make its way into the containers 6 and/or from the input region 2 into the output region 3.

Figure 15:
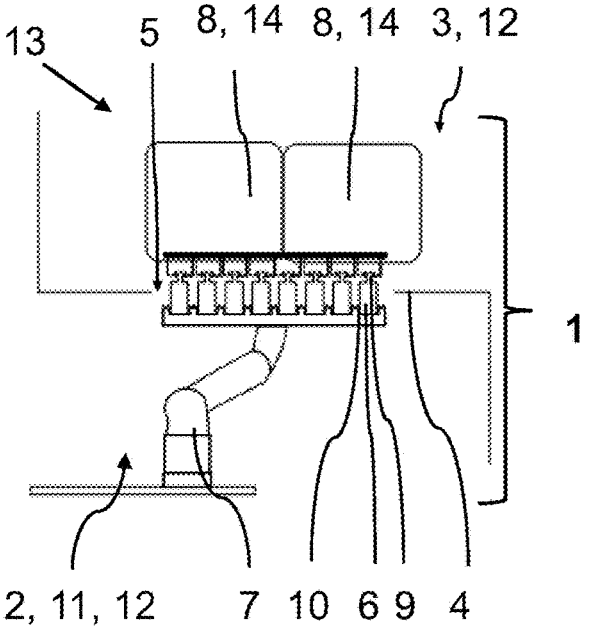
Figure 16:
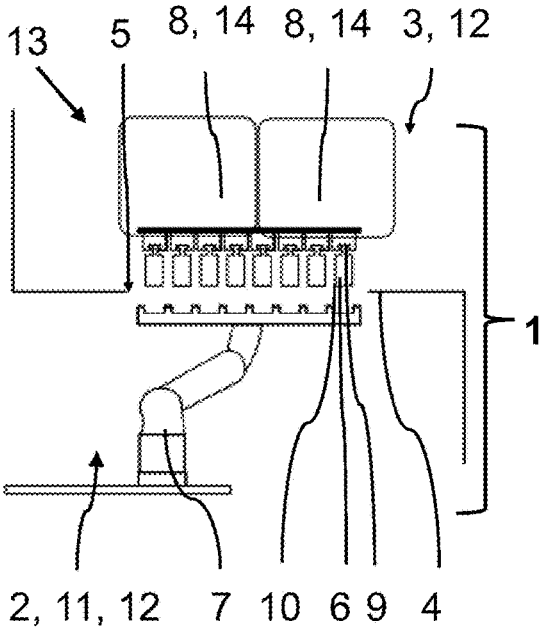
Figure 17:
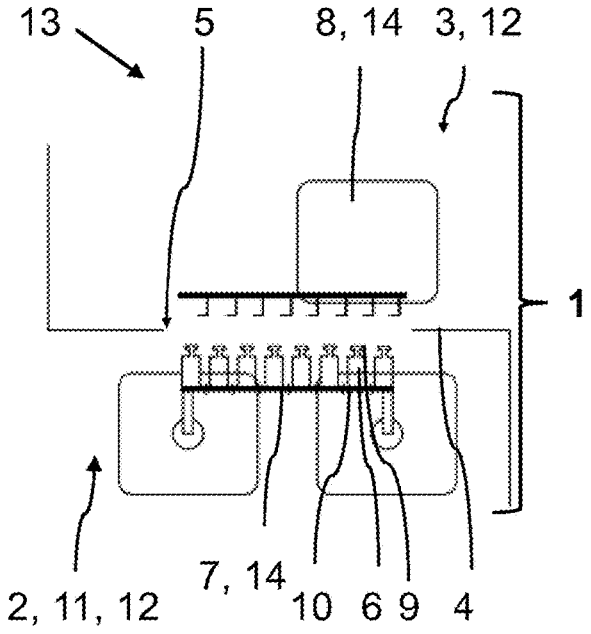
FIGS. 17 to 20 show a method according to the invention using a fourth alternative embodiment of an arrangement according to the invention.
Figure 18:
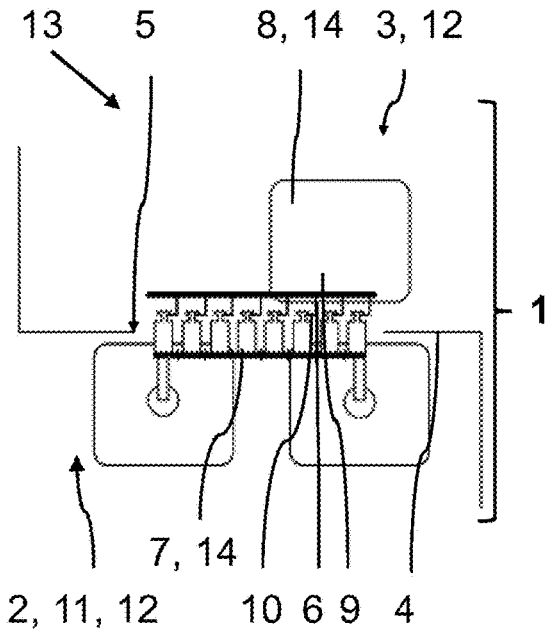
Figure 19:
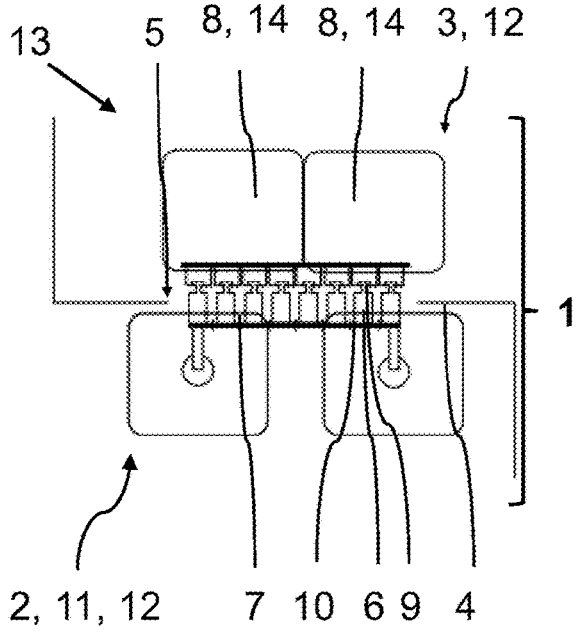
Figure 20:
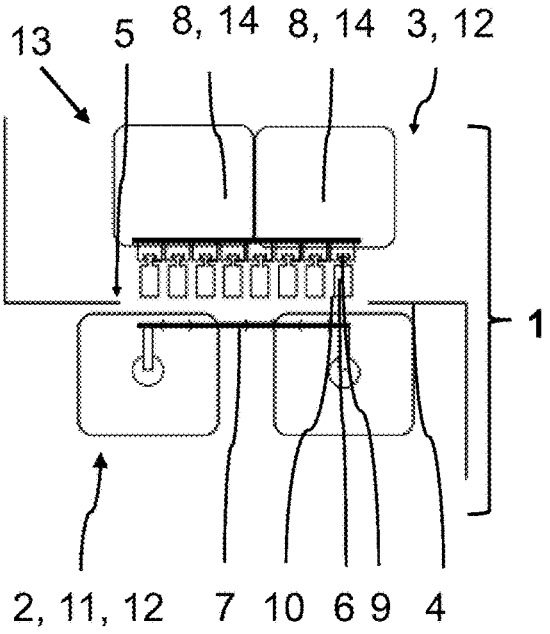
Figure 21:
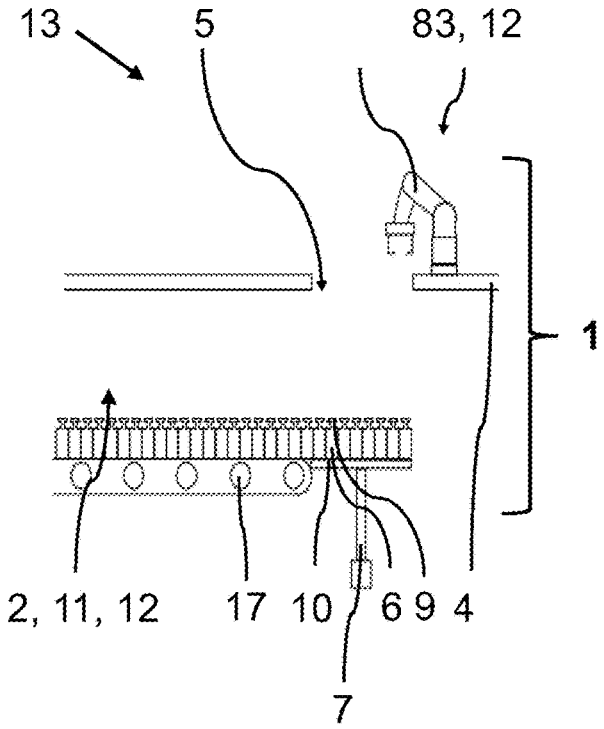
FIGS. 21 to 24 show a method according to the invention using a fifth alternative embodiment of an arrangement according to the invention.
Figure 22:
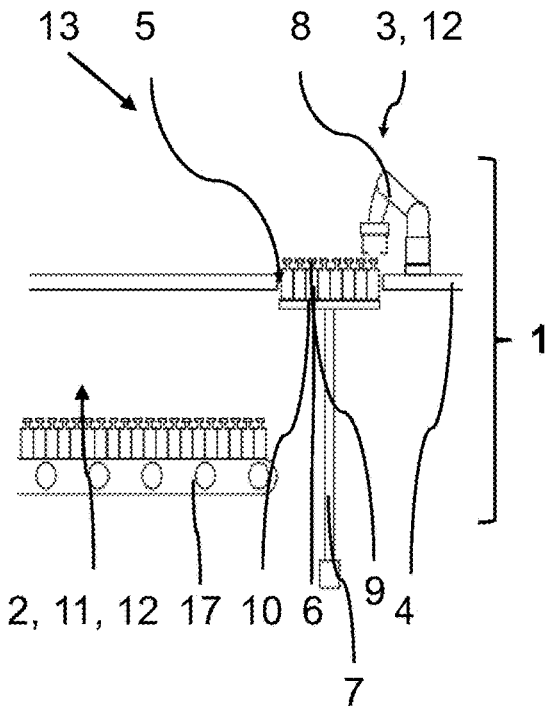
Figure 23:
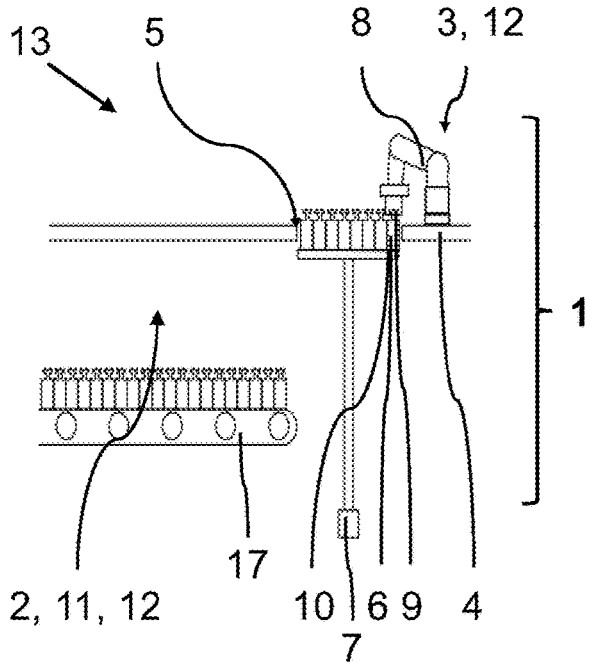

A transfer can be designed even more flexibly and reliably when the second transport device 8 consists of at least two movers 14 which are movable independently of one another, as can be seen in the alternative arrangements 1 from FIGS. 13 to 16 and 17 to 20. In this way, receiving the containers 6, comprising at least two steps, can be carried out by the second transport device 8 during transfer, wherein a first mover 14 initially grips the containers 6 (FIGS. 14, 18), and a second mover 14 subsequently and additionally grips the containers 6 (FIGS. 15, 19). In this way, the following discharge of the containers 6 into the output region 3 can be carried out at a higher level of reliability, in particular when the containers 6 have already been filled and thus are relatively heavy.

Figure 30:
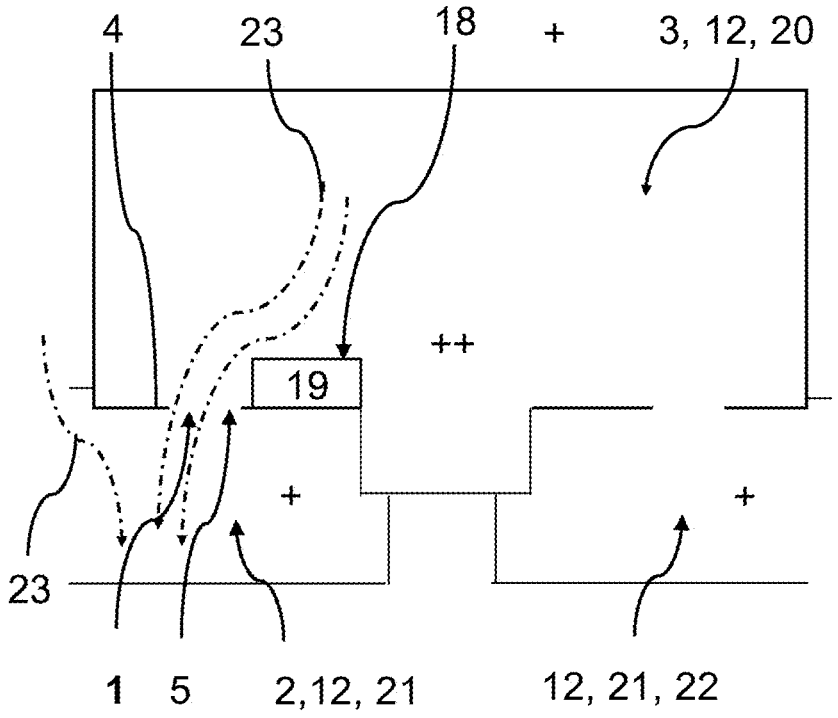
FIG. 30 shows an arrangement according to the invention having a filling device according to the invention, which is positioned on a high pressure side.
Figure 31:
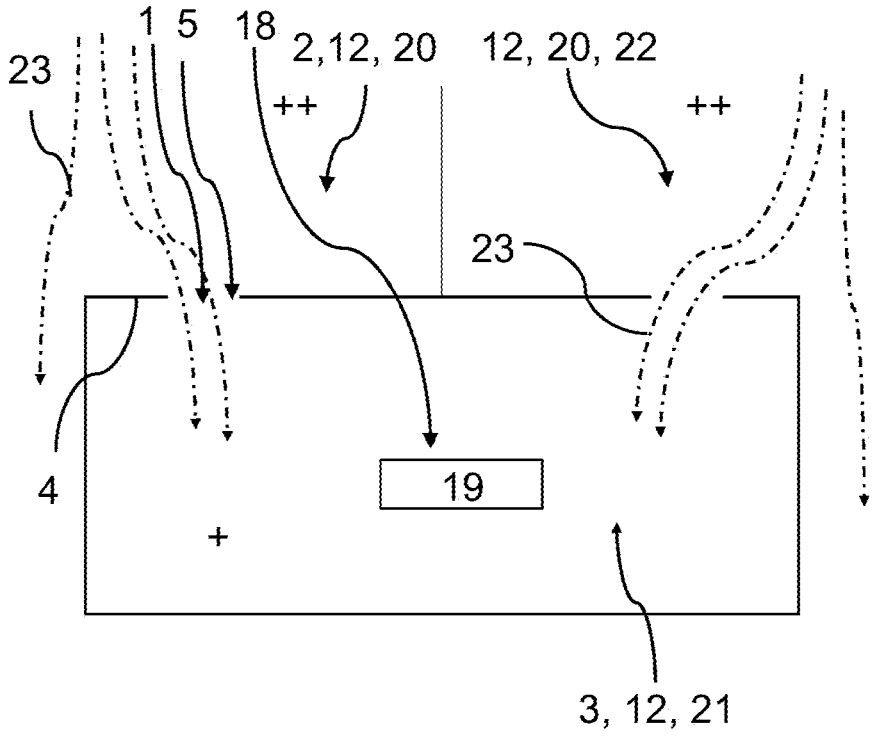
FIG. 31 shows an arrangement according to the invention having a filling device according to the invention, which is positioned on a low pressure side.

FIGS. 30 and 31 show further exemplary embodiments according to the invention. Components and functional units which are equivalent or identical to the preceding exemplary embodiments in terms of function and/or construction are provided with the same reference signs and are not described again separately. The explanations pertaining to FIGS. 1 to 29 therefore apply in an analogous manner to FIGS. 30 and 31. For additional visualization, the high pressure side 20 and the low pressure side 21 are in each case identified by "++" and "+" in FIGS. 30 and 31.

In further exemplary embodiments not shown, identical pressures prevail on both sides of the bulkhead 4.

FIG. 30 shows an arrangement 1 according to the invention having a filling device 18 according to the invention, which is positioned on a high pressure side 20.

FIG. 31 shows an arrangement 1 according to the invention having a filling device 18 according to the invention, which is positioned on a low pressure side 21.

The filling devices 18 in FIGS. 30 and 31 contain at least one filling station 19 which can fill containers 6, which are known at least from pharmaceutical filling operations, with a substance. The filling devices 18, or the at least one filling station 19, can be at least any filling device 18 or filling station 19 known to the person skilled in the art.

In the exemplary embodiment of FIG. 30, a container 6 can be transferred from a low pressure side 21 into the output region 3, 12 by an arrangement 1 as described above or claimed hereunder, and/or by a method for transferring, as described above or claimed hereunder, the output region 3, 12 forming a high pressure side 20. A region 12 which is protected in such a manner and contains at least one arrangement 1 and a filling device 18 is particularly suitable for the aseptic filling of containers 6, for example with medicines. The filling device 18 comprises part of the bulkhead 4. In this way, the containers 6 can be filled at the filling station 19 shortly after transfer, so that an overall processing time can be shortened.

In the exemplary embodiment of FIG. 31, a container 6 can be transferred from a high pressure side 20 into the output region 3, 12 by an arrangement 1 as described above or claimed hereunder, and/or by a method for transferring as described above or claimed hereunder, the output region 3, 12 forming a low pressure side 21. A region 12 which is protected in such a manner and contains at least one arrangement 1 and a filling device 18 is particularly suitable for filling containers 6 with toxic substances (high-potent products).

In the exemplary embodiments of FIGS. 30 and 31, the output region 3, 12 is contiguous to a process chamber 22, wherein a pressure difference exists between the output region 3, 12 and the process chamber 22, which difference has the same algebraic sign as the pressure difference between the respective output region 3, 12 and the respective input region 2, 12. In this way, the filling station 19, or the output region 3, 12, or an environment outside the output region, can be protected from leaking liquid in a particularly effective manner.

It can also be provided that no pressure difference exists between the output region 3, 12 and the process chamber 22 and/or the input region 2, 12.

It is furthermore shown in FIGS. 30 and 31 that the opening 5 is aligned between a high pressure side 20 and a low pressure side 21 in such a way that a resultant air flow 23 through the opening 5 assumes an angle of less than 90° in relation to an air flow 23 running vertically from top to bottom. A laminar or low-turbulence air flow 23 between the high pressure side 20 and the low pressure side 21 can advantageously be guaranteed as a result. This enables a contamination-free transfer and safe working conditions in protected regions 12.

In many exemplary embodiments the direction of the air flow is directed from top to bottom, so that the exemplary embodiments shown are implemented.

The exemplary embodiments of FIGS. 32 to 39 show alternative gripping points 31 of the first and second transport devices 7, 8 in relation to planes 24 extending through the container 6, in particular mirror planes 25 of the latter, during transfer in a method described herein, the latter potentially proceeding in particular as described hereunder.

The method can in particular advantageously be carried out in arrangements 1 described herein for a contamination-free transfer of at least one container 6, but also in other arrangements 1. Components and functional units which are equivalent or identical to the preceding exemplary embodiments in terms of function and/or construction are provided with the same reference signs and are not described again separately. The explanations pertaining to FIGS. 1 to 31 therefore apply in an analogous manner to FIGS. 32 to 41.

The first transport device 7, 14 and the second transport device 8 (in the embodiments of FIGS. 32, 33 and 36, 37) or 8, 14 (in the embodiments of FIGS. 34, 35 and 38, 39) are designed for transferring the at least one container 6 with a closable or closed container opening 9, wherein the first transport device 7, 14 and the second transport device 8 or 8, 14 are designed in such a way that the at least one container 6 is gripped by the gripping element 26 of the first transport device 7, 14 at a different distance from the container opening 9 than by the gripping element 27 of the second transport device 8 or 8, 14 (FIGS. 32 to 39).

In the process, the container 6 during transfer is gripped by the first transport device 7, 14 and the second transport device 8 or 8, 14 in such a way that the mirror plane 24, 25 of the container 6, extending through the container 6, is positioned between the gripping points of the first transport device 7, 14 and the second transport device 8 or 8, 14 (FIGS. 32, 34, 36 and 38). These are particularly preferred embodiments because the two transport devices 7, 14 and 8/8, 14 do not reach through the mirror plane 24, 25 and are disposed outside this mirror plane 24, 25, or spaced apart from the container 6. In this way, a transmission of contamination is advantageously particularly heavily reduced or even prevented in the horizontal and vertical extent in these embodiments.

Figure 37:
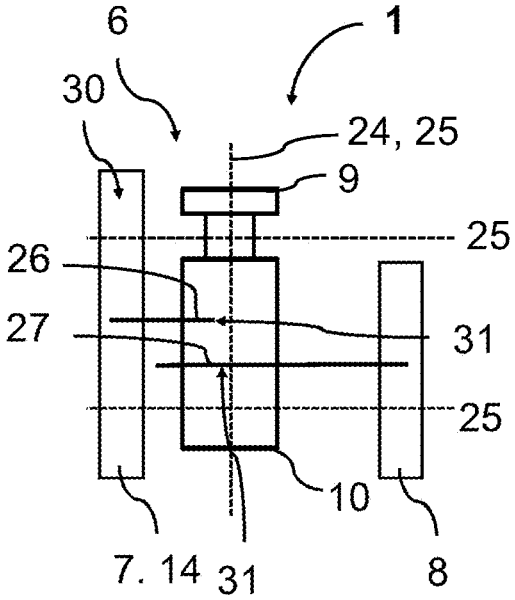
Figure 39:
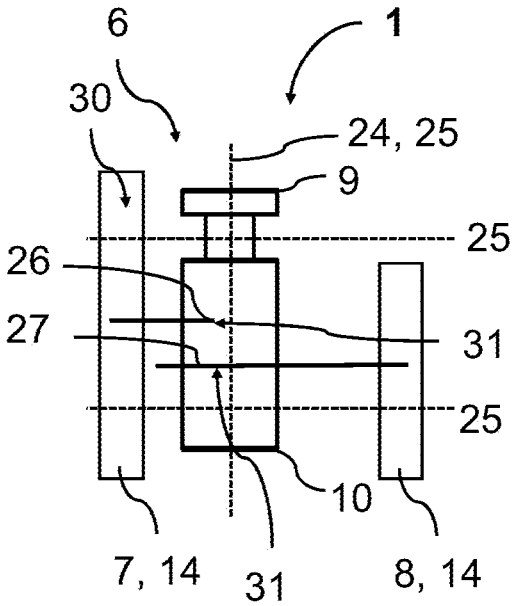

In the embodiments of FIGS. 37 and 39, particularly a transmission of contamination is likewise heavily reduced or even prevented, because the horizontal plane 25, depicted just below the container opening 9, is not penetrated by the second transport device 8 (FIG. 37) or 8, 14 (FIG. 39), because the highest horizontal point of this horizontal plane 25 extends below this axis 25.

Figure 38:
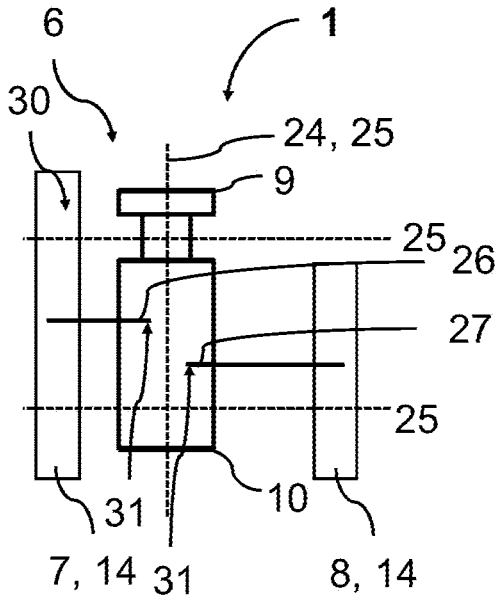
Figure 40:
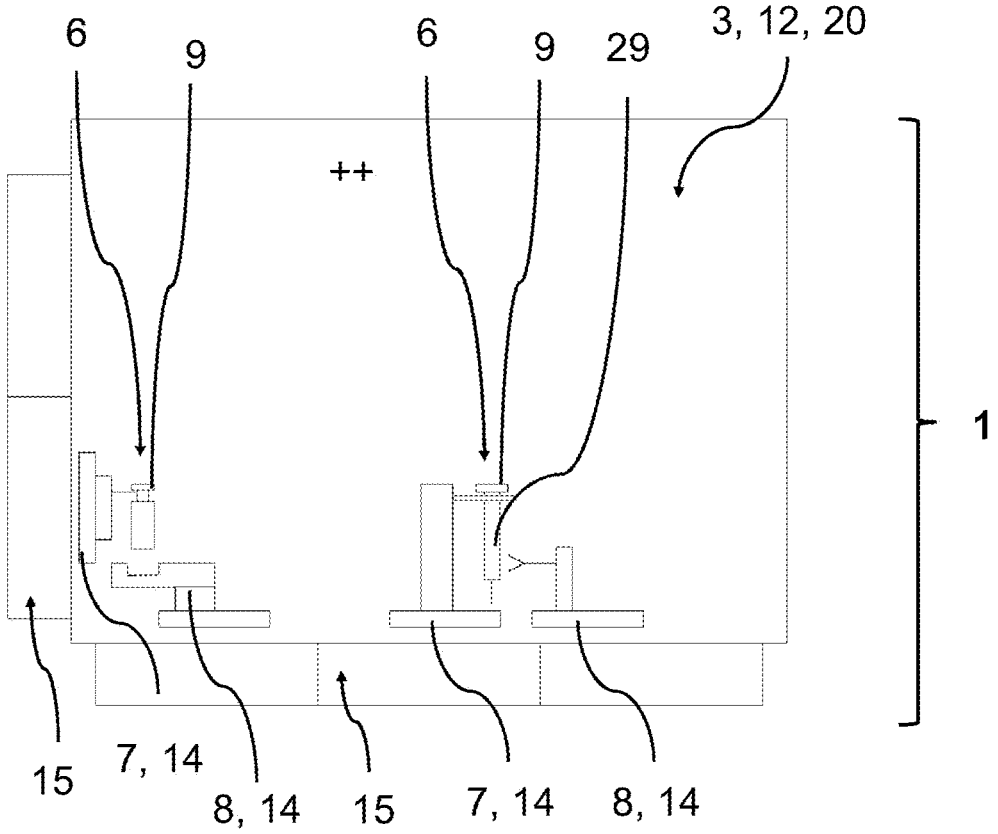
FIG. 40 shows a method for transferring a container in another alternative embodiment of an arrangement according to the invention.

The embodiment according to FIG. 38 is furthermore explained by way of example in the arrangement 1 shown in FIG. 40, wherein a container 6 designed as a dispensing device 29 is transferred herein. FIG. 40 moreover shows the transfer of a container 6, wherein the first transport device 7, 14 is displaced on a vertically disposed stator assembly 15. In this transfer from the first transport device 7, 14 to the second transport device 8, 14 the container 6 is also gripped by the first transport device 7, 14 at a different distance from the container opening 9 than by the second transport device 8 or 8, 14.

Figure 32:
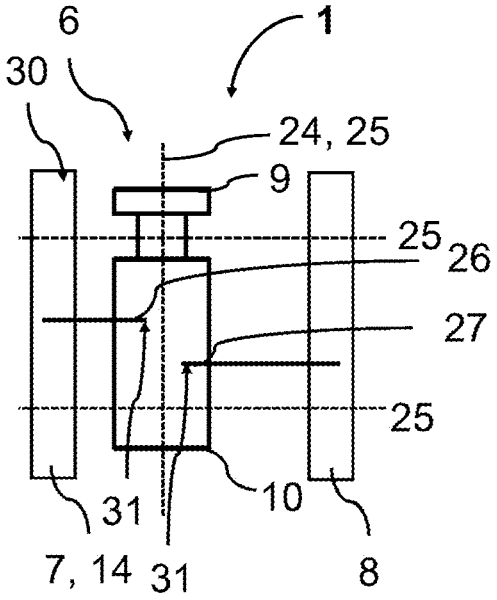
FIGS. 32 to 39 show alternative gripping points of the first and second transport devices in relation to planes extending through the container during transfer.
Figure 33:
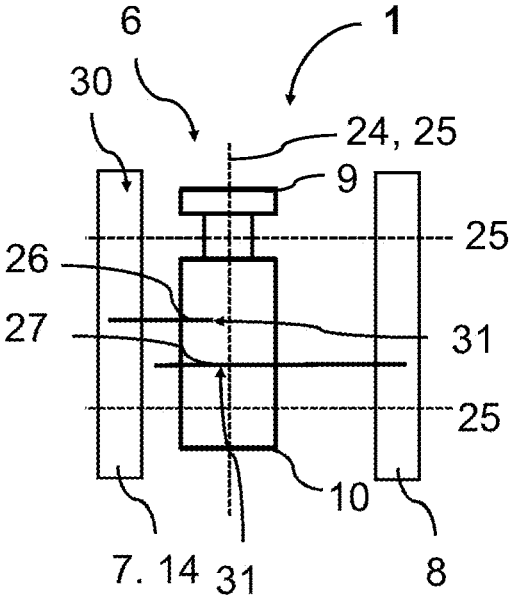
Figure 34:
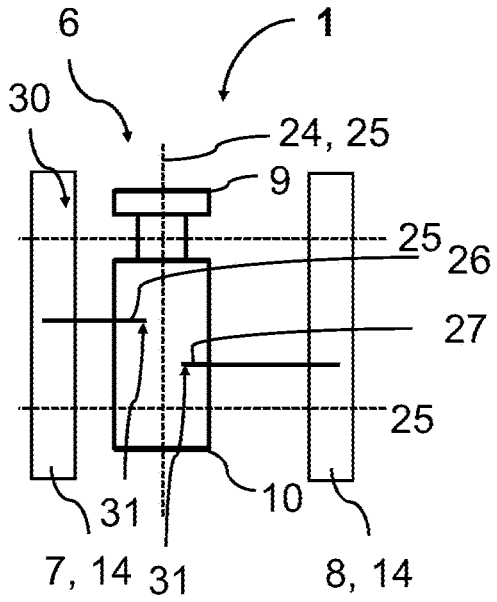
Figure 35:
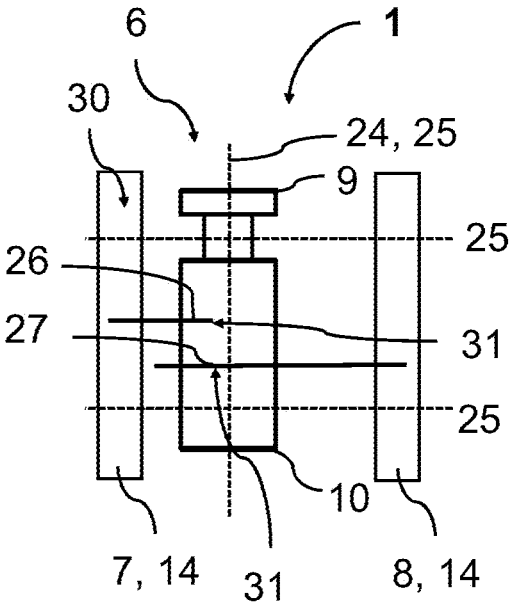
Figure 36:
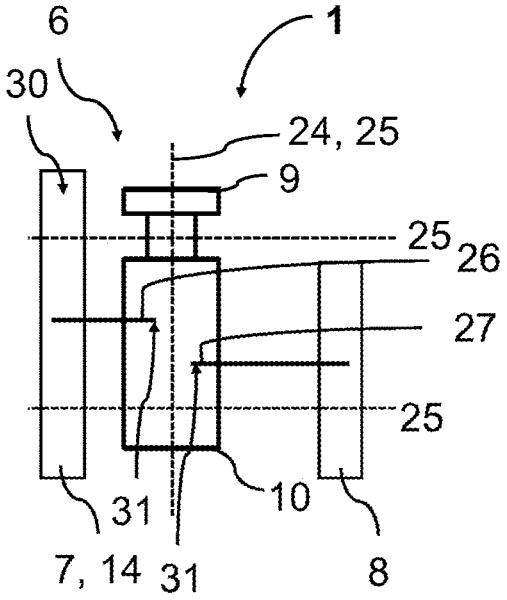
Figure 41:
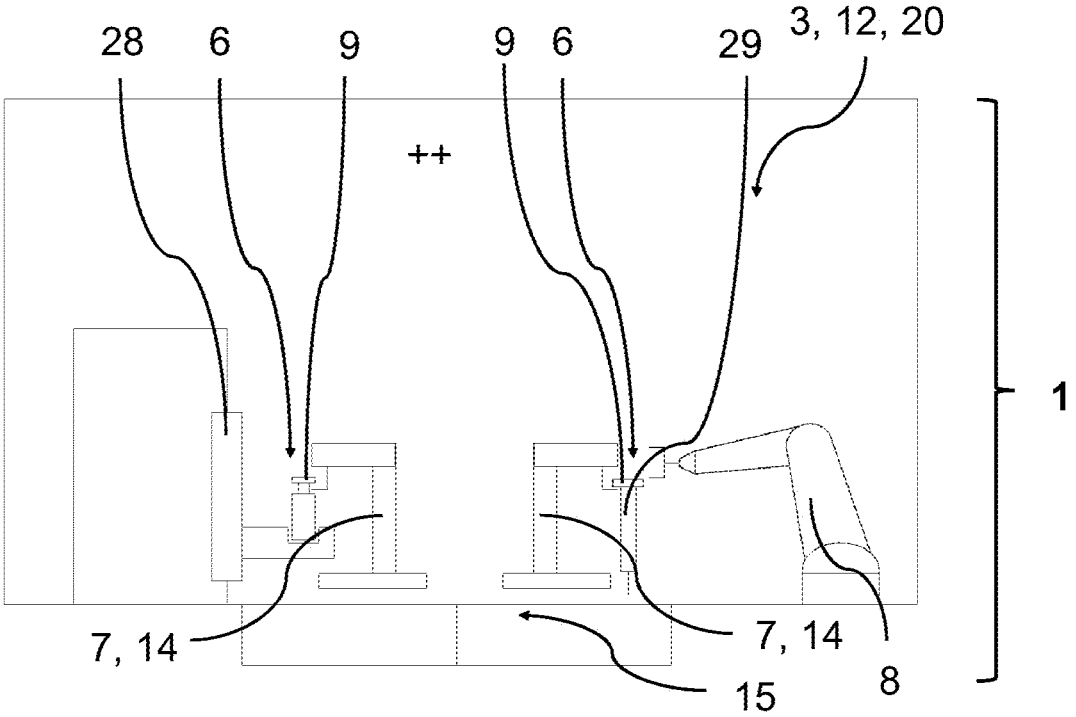
FIG. 41 shows an alternative method for transferring a container in another alternative embodiment of an arrangement according to the invention.

The embodiment according to FIG. 32 is furthermore explained by way of example in the arrangement 1 shown in FIG. 41, wherein a container 6 designed as a dispensing device 29 is transferred herein. The second transport device 8 here is designed as a robotic gripper.

FIG. 41 moreover shows the transfer of a container 6 from another first transport device 7, 14 to a processing station 28. In this transfer from the transport device 7, 14 to the processing station 28 the container 6 is also gripped by the first transport device 7, 14 at a different distance from the container opening 9 than by the processing station 28.

In the embodiments of FIGS. 32 to 39 the method for transferring is monitored by a monitoring unit 30 which is formed on the transport unit 7, 14. Monitoring of this type is or can also be provided in the further embodiments described herein.

The transport devices 7, 14 and 8, 14 which are described herein and are movable on a magnetically levitated and on a horizontal drive surface can be used for transporting a container 6 from a first processing station 28 to a second processing station 28, in particular within a controlled environment, in particular within an isolator.

The invention thus generally proposes an arrangement 1, a filling device 18 and a method for transferring a container 6 provided with a preferably closable or closed container opening 9 from an input region 2 into an output region 3, wherein the container 6 is held in the input region 2 by a first transport device 7, and the container 6 is transferred to a second transport device 8, which is disposed in the output region 3, through an opening 5 in a bulkhead 4, and wherein the input region 2 and the output region 3 are separated by the bulkhead 4, and wherein the container 6 for transferring is gripped by the first transport device 7 at a different distance from the container opening 9 than by the second transport device 8.

LIST OF REFERENCE SIGNS

1 Arrangement
2 Input region
3 Output region
4 Bulkhead
5 Opening of 4
6 Container
7 First transport device
8 Second transport device
9 Container opening
10 Base of the container 6
11 Region of lower pressure
12 Protected region
13 Isolator
14 Mover
15 Stator assembly
16 Bulkhead region
17 Third transport device
18 Filling device
19 Filling station
20 High pressure side
21 Low pressure side
22 Process chamber
23 Air flow
24 Plane of 6
25 Mirror plane of 6
26 Gripping element of 7
27 Gripping element of 8
28 Processing station
29 Dispensing unit
30 Monitoring unit
31 Gripping point
++ High pressure side
+ Low pressure side

The invention claimed is:

1. An arrangement (1), comprising:

at least one input region (2) and one output region (3) which are mutually separated by a bulkhead (4), the bulkhead (4) has at least one opening (5) through which at least one container (6) having a closable or closed container opening (9) is able to be transferred, the input region (2) has a first transport device (7) on an input region side of the bulkhead, the output region (3) has a second transport device (8) on an output region side of the bulkhead (4), and for transfer, the first transport device (7) and the second transport device (8) are designed such that the at least one container (6) is adapted to be gripped by the first transport device (7) at a different distance from the container opening (9) than by the second transport device (8).

2. The arrangement (1) as claimed in claim 1, wherein the at least one container (6) is adapted to be positioned partially in the input region (2) and partially in the output region (3) for receiving by the second transport device (8).

3. The arrangement (1) as claimed in claim 1, wherein at least one of the first transport device (7) or the second transport device (8) is positioned outside the opening (5), and/or the first and the second transport device (7, 8) do not protrude or reach through the opening (5).

4. The arrangement (1) as claimed in claim 1, wherein at least one of a) the container opening (9) and a base (10) of the container (6) are disposed on different sides of the opening (5) when the container (6) is gripped by the first transport device (7) and the second transport device (8), or b) the bulkhead (4) is positioned between the gripping points of the first and of the second transport device (7, 8).

5. The arrangement (1) as claimed in claim 1, wherein at least one of a) a pressure difference is provided between the output region (3) and the input region (2), the opening (5) is disposed such that the region (11) of lower pressure is below the opening (5), or b) at least one of the input region (2) or the output region (3) is designed as part of a protected region (12).

6. The arrangement (1) as claimed in claim 1, wherein at least one of a) the bulkhead (4) is designed to be curved at least in a bulkhead region (16) that comprises the opening (5), b) the at least one opening (5) is formed in at least one of a horizontal, oblique, or vertical portion of the bulkhead (4), c) the at least one opening (5) is adaptable to dimensions of the at least one container (6) by a replaceable sheet-metal panel, or d) at least two of the containers (6) are adapted to be simultaneously transferred through the at least one opening (5).

7. The arrangement (1) as claimed in claim 1, wherein at least one of the first or the second transport device (7, 8) is connected to the bulkhead (4).

8. The arrangement (1) as claimed in claim 1, wherein at least one of the first or second transport devices (7, 8) is a mover (14) which is magnetically coupled to a stator assembly (15) that is configured to be levitate and/or move the mover (14) by a magnetic field.

9. The arrangement (1) as claimed in claim 1, wherein the at least one container (6) is adapted to be transferred into the output region (3) by a movement with at least one of a vertical or horizontal component of at least one of the first or of the second transport device (7, 8).

10. The arrangement (1) as claimed in claim 1, wherein the opening (5) is aligned between a high pressure side (20) and a low pressure side (21) such that a resultant air flow (23) through the opening (5) assumes an angle of less than 90° in relation to an air flow (23) running vertically from top to bottom.

11. The arrangement of claim 1, further comprising a filling device (18) including at least one filling station (19) disposed in the output region (3) of, wherein there is a pressure difference in relation to the input region (2) exists in the output region (3).

12. The arrangement as claimed in claim 11, wherein the at least one filling station (19) is positioned on a high pressure side (20) or a low pressure side (21).

13. The arrangement as claimed in claim 12, wherein the output region (3) is contiguous to a process chamber (22), wherein a pressure difference in relation to the process chamber (22) exists between the output region (3), and this pressure difference has a same algebraic sign as the pressure difference between the output region (3) and the input region (2).

14. The arrangement as claimed in claim 1, wherein at least one of the first or second transport device comprises a magnetically levitated transport device, which is movable on a non-vertical for transporting the container, from a first processing station to a second processing station.

15. An arrangement (1), comprising:

a first transport device (7), comprising a mover (14) that is configured to be levitated and/or moved by a magnetic field, and a second transport device (8), comprising a mover (14) that is configured to be levitated and/or moved by a magnetic field, for transferring at least one container (6) designed with a closable or closed container opening (9), wherein the first transport device (7) and the second transport device (8) are designed such that the at least one container (6) is able to be gripped by the first transport device (7) at least at one of an identical distance to or a different distance from the container opening (9) than by the second transport device (8), and the container (6) is in each case adapted to be gripped by the first transport device (7) and by the second transport device (8) at at least one gripping point (31) such that a plane (24) of the container (6), extending through the container (6) or intersecting the latter is positioned between the gripping points (31) of the first and of the second transport device (7, 8).

16. The arrangement (1) as claimed in claim 15, further comprising at least one position sensor formed on at least one of the first or the second transport device (7, 8).

17. A method for transferring a container (6) provided with a container opening (9) from an input region (2) into an output region (3), the method comprising:

holding the container (6) in the input region (2) by a first transport device (7) located on a first side of a bulkhead (4), transferring the container (6) to a second transport device (8), which is disposed in the output region (3) located on an opposite side of the bulkhead (4), through an opening (5) in the bulkhead (4), wherein the input region (2) and the output region (3) are separated by the bulkhead (4), and for transferring the container, gripping the container (6) by the first transport device (7) at a different distance from the container opening (9) than gripping of the container (6) by the second transport device (8).

18. The method as claimed in claim 17, wherein at least one of the first transport device (7) or the second transport device (8) remains outside the opening (5) at least during the transferring.

19. The method as claimed in claim 17, wherein at least two containers (6) are transferred, and the at least two containers (6) are not singularized during transfer.

20. The method as claimed in claim 17, wherein at least two of the containers (6) are transferred, and the gripping further comprises individually gripping each of the containers (6) by the second transport device (8).

21. The method as claimed in claim 17, wherein at least one of a) the at least one container (6) is transferred into the output region (3) by a movement with at least one of a vertical or a horizontal movement component of at least one of the first or the second transport device (7, 8), or b) a mover (14), which is magnetically coupled to a stator assembly (15) that is configured to levitate and/or move the mover (14), is used as at least one of the first or the second transport device (7, 8).

22. A method for transferring a container (6) provided with a container opening (9), the method comprising:

holding the container (6) by a first transport device (7) located on an input region side of a bulkhead, transferring the container (6) to a second transport device (8) located on an output region side of the bulkhead, wherein at least one of the first or the second transport device (7, 8) is designed as a mover (14) which is magnetically coupled to a stator assembly (15) that is configured to levitate and/or move the mover (14), and for transferring, gripping the container (6) by the first transport device (7) at one of an identical distance to or a different distance from the container opening (9) than by the second transport device (8).

23. The method as claimed in claim 22, wherein the container (6) is gripped by the first and the second transport device (7, 8), and at least one of the first transport device (7) or the second transport device (8) at least during transfer does not protrude or reach through a plane (24) extending through the container (6) or intersecting the container (6).

24. The method as claimed in claim 22, further comprising monitoring the transferring by at least one position sensor formed on at least one of the first or the second transport device (7, 8).

25. The method as claimed in claim 22, further comprising transporting the at least one container (6) to a filling device (18) for filling.

* * * * *